US010385674B2

(12) United States Patent
Ahmed

(10) Patent No.: US 10,385,674 B2
(45) Date of Patent: Aug. 20, 2019

(54) METHOD AND SYSTEM FOR AUTOMATED WELL EVENT DETECTION AND RESPONSE

(71) Applicant: Chevron U.S.A. Inc., San Ramon, CA (US)

(72) Inventor: Anmar Ahmed, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 181 days.

(21) Appl. No.: 15/462,500

(22) Filed: Mar. 17, 2017

(65) Prior Publication Data

US 2018/0266233 A1 Sep. 20, 2018

(51) Int. Cl.
*E21B 44/00* (2006.01)
*E21B 47/04* (2012.01)

(52) U.S. Cl.
CPC ..... *E21B 44/00* (2013.01); *E21B 47/042* (2013.01)

(58) Field of Classification Search
CPC ..... E21B 44/00; E21B 47/042
See application file for complete search history.

(56) References Cited

U.S. PATENT DOCUMENTS

| | | | | |
|---|---|---|---|---|
| 8,978,774 | B2 * | 3/2015 | Fossli | E21B 21/001 166/347 |
| 9,222,308 | B2 | 12/2015 | Zeineddine et al. | |
| 9,506,305 | B2 * | 11/2016 | Leuchtenberg | E21B 21/001 |
| 9,963,947 | B2 * | 5/2018 | Kjosnes | E21B 33/085 |
| 2007/0235223 | A1 * | 10/2007 | Tarr | E21B 21/08 175/7 |
| 2012/0123756 | A1 | 5/2012 | Wang et al. | |
| 2013/0192841 | A1 * | 8/2013 | Feasey | E21B 21/08 166/336 |
| 2015/0134258 | A1 | 5/2015 | Luppens et al. | |
| 2015/0300151 | A1 | 10/2015 | Mohaghegh | |

* cited by examiner

*Primary Examiner* — Matthew R Buck
(74) *Attorney, Agent, or Firm* — Andrew J. Lagatta; Karen DiDomenicis; Melissa M. Hayworth

(57) ABSTRACT

Methods and systems for automated well event detection and response are provided herein. Example methods are implemented in an automated tripping management application. The application can execute to perform a remote management function for operation of a drilling rig. This includes monitoring actual and calculated running speeds, bottom hole pressures, and drill string pressures based on fluids used at the drilling rig, and generating both alerts in the event of operation outside of predetermined thresholds, and recommended adjustments to operation of one or more drilling rigs. The thresholds and alerting can be based on a set of operating rules developed to automate monitoring of such processes in a way that additional events are detected and responded to.

20 Claims, 37 Drawing Sheets

300

500

600

| S1 | | |
|---|---|---|
| DP size (in) | DP wt (lb/ft) | Displacement (bbl/ft) |
| 5 | 19.5 | 0.0278 |
| 5 | 19.5 | 0.0278 |
| 5 | 19.5 | 0.0278 |
| 5 | 19.5 | 0.0278 |
| 5 | 19.5 | 0.0278 |
| 4 | 15.7 | 0.0213 |
| 4 | 15.7 | 0.0213 |
| 4 | 15.7 | 0.0213 |
| 4 | 15.7 | 0.0213 |

700

| S2 |
|---|
| Stands Run |
| 1 |
| 1 |
| 1 |
| 1 |
| 1 |
| 1 |

800

900

1100

1200

1300

1400

1500

1600

1800

| Actual Displacement (bbl) | Theoretical Displacement (bbl) |
|---|---|
| 2.5 | 1.6 |
| 2.2 | 1.6 |
| 4.1 | 4.0 |
| 0.6 | 0.8 |
| 0.8 | 0.8 |
| 1.3 | 0.8 |
| 0.7 | 0.8 |
| -0.5 | 0.8 |

FIG. 18

1700

| Calculated Start Depth (ft) | Calculated End Depth (ft) |
|---|---|
| 4473 | 4444 |
| 4444 | 4386 |
| 4386 | 4328 |
| 4328 | 4183 |
| 4183 | 4154 |
| 4154 | 4125 |
| 4125 | 4096 |
| 4096 | 4067 |
| 4067 | 4038 |

FIG. 17

| Max Initial Pickup (klbf) |
| --- |
| 429 |
| 431 |
| 435 |
| 433 |
| 445 |
| 453 |
| 458 |

2000

FIG. 20

| Gain/Loss (bbl) | Cumulative Gain/Loss (bbl) |
| --- | --- |
| -0.9 | -0.9 |
| -0.6 | -1.5 |
| -0.1 | -1.5 |
| 0.2 | -1.3 |
| 0.0 | -1.3 |
| -0.5 | -1.8 |
| 0.1 | -1.7 |
| 2.7 | 1.0 |

1900

FIG. 19

| Total Number of Stands |
| --- |
| 1 |
| 2 |
| 3 |
| 4 |
| 5 |
| 6 |

2300

FIG. 23

| Runing Speed (ft/min) |
| --- |
| 40 |
| 35 |
| 32 |
| 30 |
| 36 |
| 40 |
| 42 |
| 40 |

2200

FIG. 22

| Actual Depth Delta (ft) | Average Stand Delta (ft) |
|---|---|
| 114.3 | 133.2 |
| 127.1 | 133.2 |
| 128.4 | 133.2 |
| 124.3 | 133.2 |
| 129.0 | 133.2 |
| 136.5 | 133.2 |
| 136.1 | 133.2 |
| 135.0 | 133.2 |

2500

FIG. 25

| DP size (in) | DP wt (lb/ft) | Displacement (bbl/ft) | Stands Run | Tank Volume @ End (bbl) | Tank Volume @ Start (bbl) | Depth @ Start (ft) | Depth @ End (ft) | Actual Disp (bbl) | Calc Disp (bbl) | Gain/Loss (bbl) | Cumulative Gain/Loss (bbl) |
|---|---|---|---|---|---|---|---|---|---|---|---|
| 4 | 15.7 | 0.0213 | 5 | 32 | 35.6 | 3197 | 3052 | 3.6 | 3.1 | -0.5 | -11.7 |
| 4 | 15.7 | 0.0213 | 7 | 27.9 | 32 | 3052 | 2849 | 4.1 | 4.3 | 0.2 | -11.5 |
| 4 | 15.7 | 0.0213 | 10 | 21.7 | 27.9 | 2849 | 2559 | 6.2 | 6.2 | 0.0 | -11.5 |
| 4 | 15.7 | 0.0213 | 3 | 19.9 | 21.7 | 2559 | 2472 | 1.8 | 1.9 | 0.1 | -11.5 |
| 4 | 15.7 | 0.0213 | 5 | 39.9 | 42.5 | 2472 | 2327 | 2.6 | 3.1 | 0.5 | -11.0 |
| 4 | 15.7 | 0.0213 | 5 | 37.5 | 39.9 | 2327 | 2182 | 2.4 | 3.1 | 0.7 | -10.3 |
| 4 | 15.7 | 0.0213 | 5 | 35.2 | 37.5 | 2182 | 2037 | 2.3 | 3.1 | 0.8 | -9.5 |
| 4 | 15.7 | 0.0213 | 5 | 33 | 35.2 | 2037 | 1892 | 2.2 | 3.1 | 0.9 | -8.6 |

4000

FIG. 40

METHOD AND SYSTEM FOR AUTOMATED WELL EVENT DETECTION AND RESPONSE

TECHNICAL FIELD

The present disclosure relates generally to monitoring of wells. In particular, the present disclosure relates to methods and systems for well event detection and response.

BACKGROUND

Well drilling requires the monitoring of mechanical and fluid flow events taking place thousands of feet underground. Operators of well drilling equipment must use various data streams from the well to analyze and interpret the actual conditions as they occur downhole. Processes that make it more efficient and reliable to determine conditions during drilling are highly desirable.

In particular, in some existing systems, monitoring of mechanical and fluid flow events occurs at both a rig site and at a centralized location at which drilling rig supervision and decisionmaking is performed. Fluid displacement monitoring is done on both the rig site by the mud logger who monitors one rig at the time and in the centralized location. At the centralized location, a realtime operator will typically monitor up to five drilling rigs, each of which is associated with a large number of operational parameters and/or measurements. Accordingly, each rig's data is displayed in a distributed manner across a number of different screens. Because each realtime operator monitors multiple rigs, that realtime operator is required to monitor many screens to determine the operational status of the rig.

Traditionally, realtime operators will review rig data to observe or recognize abnormal operation based on abnormal patterns in the data based on existing experience. For example, realtime operators may determine that changes in speed of operation of a drill rig may have an effect on the effectiveness of that drill string in performing drilling operations. Such operators may not realize immediately that such a change in speed may also result in breakage of the rock or sediment structure into which the drill string extends, thereby resulting in loss of drilling fluid.

When realtime operators detect an anomaly or other operation of a rig that might require intervention, the realtime operator may consult with a drill site manager, who is another employee at a centralized control center. The drill site manager, typically a more experienced individual, will provide advice regarding possible responses to rig conditions. Such drill site managers generally rely on their experience to identify and respond to conditions at drill sites. Drill site managers therefore rely on realtime operators located at the centralized location to identify activity at drill sites that requires a response. Meanwhile mudloggers work on the rig site.

The number and types of data sets that are monitored, and the manner in which such monitoring takes place, leads to drawbacks in monitoring. For example, because of the number and types of data monitored, realtime operators often cannot detect all possible events or anomalies for which some type of response (e.g., modified operation of a rig) would be advisable. Furthermore, due to the realities of user supervision of rig parameters, there are a number of types of data and types of rig operational vulnerabilities that go undetected by current systems. Also, because it takes some time for a pattern to become apparent to the realtime operator and additional time to assess that condition and determine an appropriate response in consultation with a drill site manager, substantial losses might occur before corrective action may be taken. Accordingly, improvements in accuracy and robustness of rig monitoring systems are desirable, as well as reduction in the possibility of user errors or oversight.

SUMMARY

In accordance with the present disclosure, the above and other problems are solved by the following:

In a first aspect, a computer-implemented method for realtime remote management of operation of a drilling rig is disclosed. The method includes monitoring a calculated actual vertical running speed of a drill string during tripping of the drill string into and from a subterranean well from the drilling rig, also known as "tripping in and tripping out," and comparing the calculated actual vertical running speed to a modeled running speed to determine whether a difference between the calculated actual vertical running speed and the modeled running speed is within a threshold which might cause damage to the mechanical tools/BHA or break the formation. Exceeding the threshold running speed would lead to loss of well integrity. Comparing the actual vs the modeled running speed also enables the calculation of potential cost savings per trip. The method also includes monitoring one or more properties of a riser cap, the riser cap comprising a fluid having a hydrostatic density greater than that of a drilling mud used in operation of the drilling rig, the riser cap being located in an annulus and external to a drill string, the riser cap having a top level and a bottom level. The method further includes calculating an effect exerted by the riser cap on a bottom hole pressure, including calculating a position of the top level and a position of the bottom level of the riser cap based at least in part on a set of positioning rules and the one or more properties of the riser cap, the positioning rules defining a dynamic position of the riser cap during tripping to measure the effect of the riser cap exerted on the bottom hole pressure, the positioning rules accounting for a total volume of the riser cap within a riser and a choke line and accounting for a difference between an original weight of drilling mud used in operation of the drilling rig and a combined weight of drilling mud and riser cap. The method also includes outputting an adjusted running speed for the drill string based, at least in part, on the bottom hole pressure exerted by the riser cap and drilling mud within the annulus.

In a second aspect, a system for managing drill rig operations, is disclosed. The system includes a computing system communicatively connected to at least one drilling rig, the at least one drilling rig comprising a drilling mechanism controlling tripping of a drill string into or from (i.e., tripping in or tripping out) a subterranean well. The computing system includes a communication interface and a microprocessor operatively connected to the communication interface to receive operational data from the at least one drilling rig. The computing system also includes a memory storing instructions forming an automated tripping management application which, when executed by the microprocessor, causes the computing system to perform a method for realtime remote management of operation of a drilling rig. The method includes monitoring a calculated actual vertical running speed of a drill string during tripping of the drill string into or from a subterranean well from the drilling rig, and monitoring one or more properties of a riser cap, the riser cap comprising a fluid having a hydrostatic density greater than that of a drilling mud used in operation of the drilling rig, the riser cap being located in an annulus and external to a drill string, the riser cap having a top level and a bottom level. The method further includes calculating an effect of the riser cap exerted on a bottom hole pressure, including calculating a position of the top level and a position of the bottom level of the riser cap based at least in part on a set of positioning rules and the one or more properties of the riser cap, the positioning rules defining a dynamic position of the riser cap during tripping to measure the effect of the riser cap exerted on the bottom hole pressure, the positioning rules accounting for a total volume of the riser cap within a riser and a choke line and accounting for a difference between an original weight of drilling mud used in operation of the drilling rig and a combined weight of drilling mud and riser cap, in other words, to measure the pressure exerted by the riser cap when expanding and shrinking. The method also includes outputting an adjusted running speed for the drill string based, at least in part, on the bottom hole pressure exerted by the riser cap and drilling mud within the annulus.

In a third aspect, a system for managing drill rig operations is disclosed. The system includes a computing system communicatively connected to at least one drilling rig, the at least one drilling rig comprising a drilling mechanism controlling tripping of a drill string into or from a subterranean well. The computing system includes a communication interface and a microprocessor operatively connected to the communication interface to receive operational data from the at least one drilling rig. The computing system also includes a memory storing instructions forming an automated tripping management application which, when executed by the microprocessor, causes the computing system to perform a method for realtime remote management of operation of a drilling rig. The method includes monitoring a calculated actual vertical running speed of a drill string during tripping of the drill string into or from a subterranean well from the drilling rig, and monitoring one or more properties of a riser cap, the riser cap comprising a fluid having a hydrostatic density greater than that of a drilling mud used in operation of the drilling rig, the riser cap being located in an annulus and external to a drill string, the riser cap having a top level and a bottom level. The method further includes calculating an effect exerted by the riser cap exerted on a bottom hole pressure, including calculating a position of the top level and a position of the bottom level of the riser cap based at least in part on a set of positioning rules and the one or more properties of the riser cap, the positioning rules defining a dynamic position of the riser cap during tripping to measure the effect of the riser cap exerted on the bottom hole pressure, the positioning rules accounting for a total volume of the riser cap within a riser and a choke line and accounting for a difference between an original weight of drilling mud used in operation of the drilling rig and a combined weight of drilling mud and riser cap. The method includes calculating a bottom hole pressure effect exerted by a slug included within the drill string, the slug comprising a fluid having a higher density than the drilling mud and calculating a pressure exerted from within the drill string based at least in part on the presence of the slug. The method includes comparing a pressure exerted from within the drill string to a pressure exerted on the drill string within the annulus; and performing at least one of (1) generating an alarm based on a determination that a difference between the pressure exerted from within the drill string based in part on the slug and the pressure exerted on the drill string within the annulus based in part on the riser cap exceeds a predefined threshold, or (2) outputting an adjusted running speed for the drill string based, at least in part, on the bottom hole pressure exerted by the riser cap, slug, and drilling mud within the annulus and drill string.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

FIG. 17 is a table view illustrating calculated start and end depth for each of a plurality of stands during tripping displayed within the graphical user interface of FIG. 3, according to a possible embodiment of the present disclosure;

FIG. 18 is a table view illustrating monitoring of actual and theoretical displacement occurring in a wellbore, displayed within the graphical user interface of FIG. 3, according to a possible embodiment of the present disclosure;

FIG. 19 is a table view illustrating monitoring of cumulative displacement, displayed within the graphical user interface of FIG. 3, according to a possible embodiment of the present disclosure;

FIG. 20 is a table view of maximum initial pickup weight for each stand within a drill string, displayed within the graphical user interface of FIG. 3, according to a possible embodiment of the present disclosure;

FIG. 22 is a table view of running speed during each stand during tripping, displayed within the graphical user interface of FIG. 3, according to a possible embodiment of the present disclosure;

FIG. 23 is a table view of a number of stands included in a drill string, displayed within the graphical user interface of FIG. 3, according to a possible embodiment of the present disclosure;

FIG. 25 is a table view of a change in depth and stand length, displayed within the graphical user interface of FIG. 3, according to a possible embodiment of the present disclosure;

FIG. 40 is a view of a displacement monitoring table generated using the graphical user interface of FIG. 3, according to a possible embodiment of the present disclosure.

DETAILED DESCRIPTION

Figure 1A:
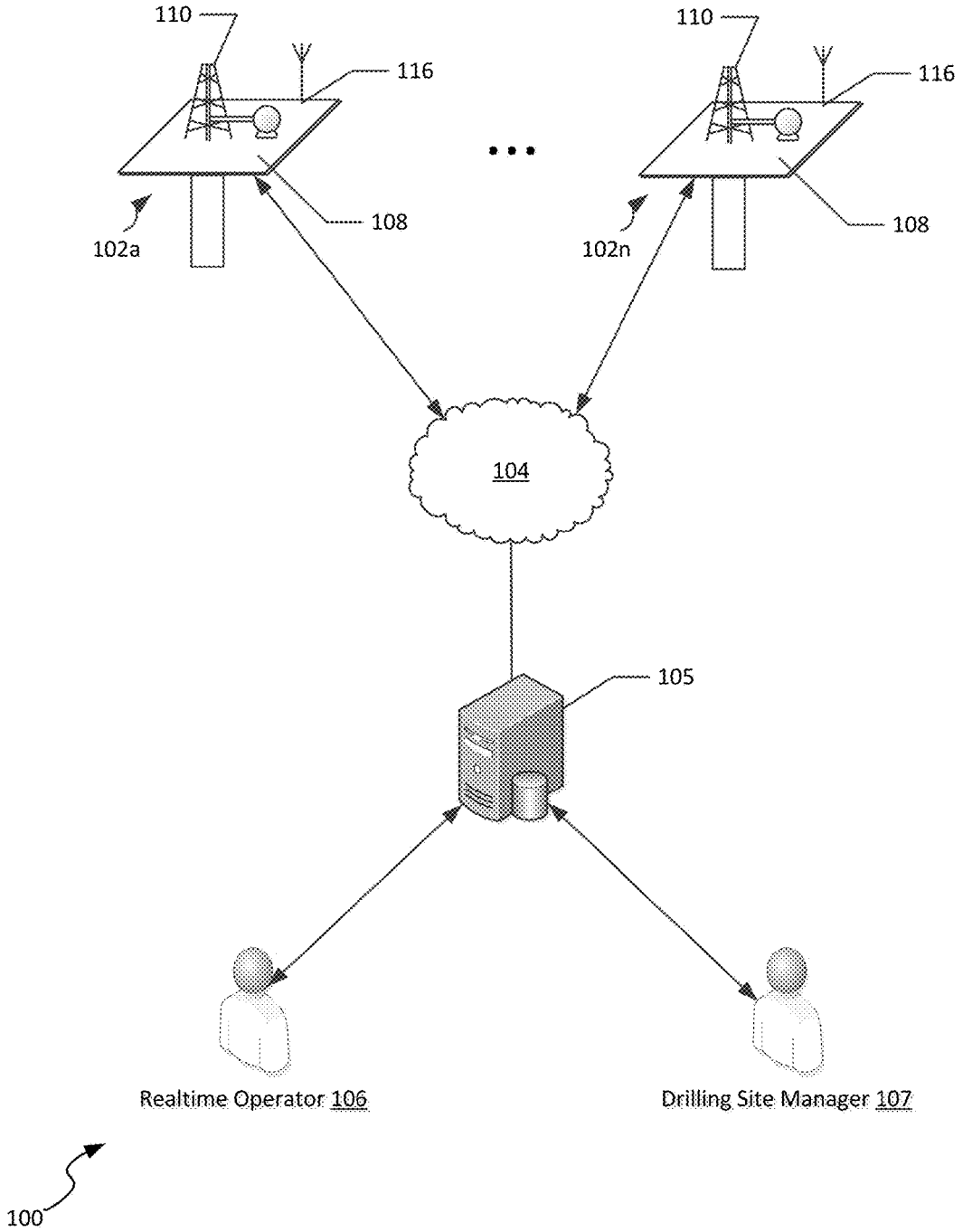
FIG. 1A illustrates a network in which aspects of the present disclosure can be implemented.

As briefly described above, embodiments of the present disclosure are directed to systems and methods for automated detection and management of well events, for example at drilling rigs. The present disclosure provides for an automated detection and response system in which rules previously applied based on user experience are managed within an online aggregated data analysis tool, as well as new rules that would not have previously been assessed due to the lack of user-perceptability. Accordingly, the system can more quickly notify end users, such as drillsite managers, of anomalies previously monitored, and can also prompt drillsite managers to react to anomalies that are now detectable by that system (but which were previously not generally perceptible by realtime operators). In particular, events occurring during tripping of a drill rig (e.g., from a time in which a drill string is inserted into a hole to conduct drilling operations until a time at which the drill string is extracted from the hole). Such a system can, in some embodiments: (1) capture anomalies in data traces, (2) alert the operators to such deviations, and (3) allow operators to focus on numerous high priority data streams from other wells simultaneously.

In particular embodiments, the present disclosure provides an application that alerts based on particular conditions in a number of different tripping scenarios by monitoring various parameters of the drilling operation. This can include reducing risk of breaking the subterranean formation due to a high bottom hole pressure caused by too high of a riser cap or slug volume, or cap expansion during a tripping operation, as well as a reduced risk of influx by realtime monitoring and comparison of bottom hole pressures and pore pressures. Additionally, indicators to a user can be provided as to when a U-tube effect might take place, or when a bottom of the riser cap approaches a choke line, boost line or kill line of a drilling mechanism.

Various other alerts can be created as well based on a set of defined rules that were previously not available to realtime operators or drilling site managers, leading to improved operation of drilling rigs and substantial cost savings at drilling sites by improving the operational response time of the rigs to conditions encountered during tripping. In such instances, an automated well event detection and response system can be executed and cause display of a user interface including various alerts to a user based on rules calculated by the system that detect the state of various aspects of the drilling rig and wellbore during tripping.

I. Automated Well Event Detection and Response System, Generally

Referring first to FIGS. 1-5, an automated well event detection and response system is described that can be used to implement aspects of the present disclosure, according to example embodiments. Referring to FIG. 1A a schematic illustration of a drilling system 100 is provided including a plurality of drilling rigs 102*a-n* communicatively connected to a drill site management server 105 via a network 104. The drilling system 100 can be used, for example to host the automated well event detection and response system.

In FIG. 1A, each of the drilling rigs 102*a-n* can be either land-based or offshore drilling rigs, and can include, for example, a drilling platform 108 at which a plurality of rig operators work, a drilling mechanism 110, and a communication mechanism 116. The drilling mechanism 110 includes drilling equipment and a driving force at which the rig operators add/remove segments of drill string to advance or remove a drill string within a new or existing hole. Relevant details regarding portions of a drilling mechanism 110 are provided in further detail below. The communication mechanism 116 can correspond to any wired or wireless network connection capable of providing frequent, or near-realtime, data from the associated drilling rig 102 to the drill site management server 105.

The drill site management server 105 can correspond to one or more computing systems monitored by one or more realtime operators 106 and optionally one or more drilling site managers 107. The drill site management server 105 can, in example embodiments, host an automated well event detection and response system, which can be implemented as a tool interfacing with collected data from the drilling rigs 102*a-n*. Possible embodiments of such a well event detection and response system are described below.

The one or more realtime operators 106 have primary responsibility to monitor data at the drill site management server 105, e.g., via the automated well event detection and response system. Accordingly, the drill site management server 105 can typically be implemented using a plurality of computing systems accessed by different realtime operators 106 who each have responsibility for detecting events associated with a subset of the drilling rigs 102*a-n*. The one or more drilling site managers 107 consult with the realtime operators 106 to assess events and respond appropriately. Details regarding automated detection of events that were previously required to be monitored and assessed by the realtime operators 106 and drilling side managers are provided below.

Figure 1B:
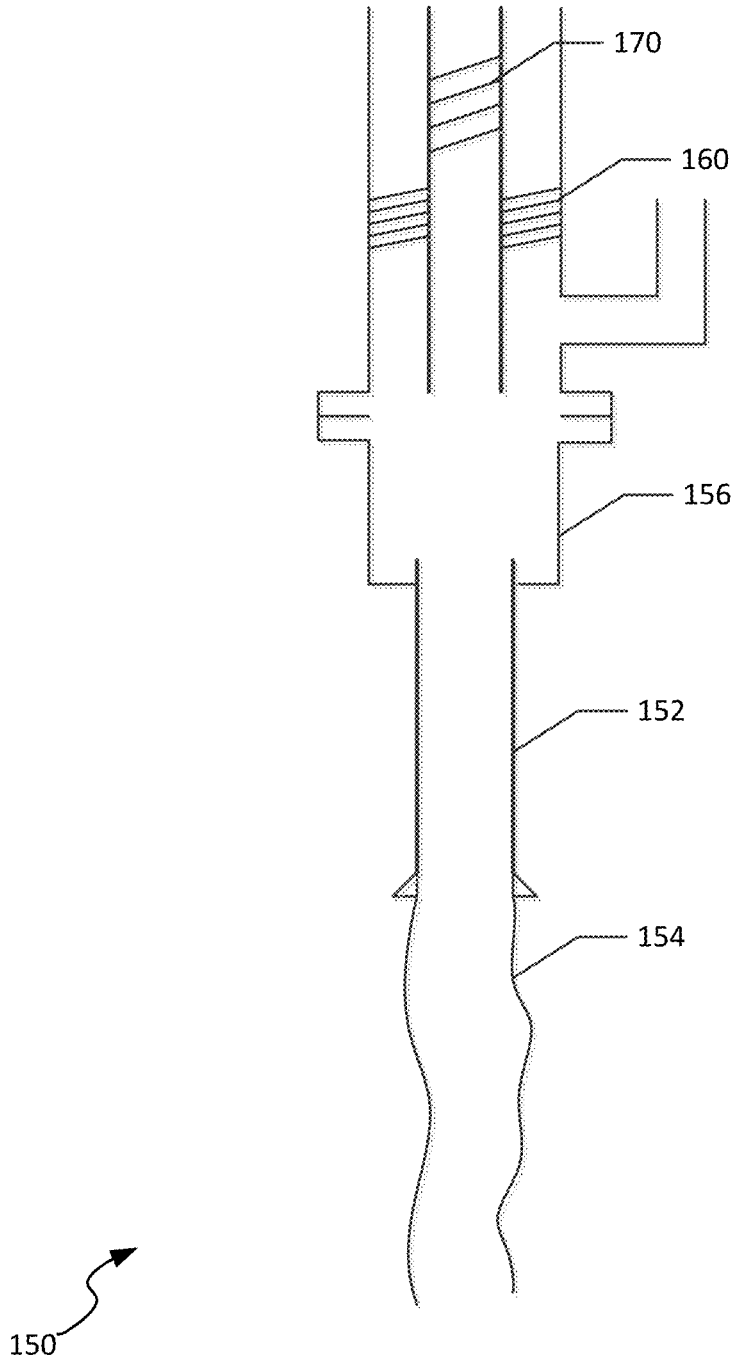
FIG. 1B is a schematic view of a wellsite including a drilling mechanism, showing aspects to be monitored by the systems and methods of the present disclosure.

Referring to FIG. 1B, a portion of an example drilling mechanism 110 is illustrated. In particular, a portion of a drilling mechanism 110 is disclosed that extends into a hole being drilled. The drilling mechanism includes a casing 152 extending down into a drilled hole 154, and connected to a riser 156. The casing 152 houses a plurality of segments of a drill string 150 as well as a bit (not shown) located at a downhole end of the drill string that is used for drilling operations within the drilled hole 154. The drilling mechanism is driven using drilling fluid, or mud, which is expelled through the bit and returns to the surface. The returning mud, returned upward along the drill string and through the casing 152, cools and lubricates the drill bit, lifts drill cuttings to the surface and provides hydrostatic pressure to mechanically stabilize the wellbore and prevent fluid under pressure disposed in certain permeable formations exposed to the wellbore from entering the wellbore.

In example usage of the drilling mechanism 110, in addition to drilling mud, other types of fluids can be used to assist in equalizing downhole pressures as drill string segments are added to or removed from the drill string during tripping of the drill string. For example, a riser cap 160 can be added external to the drill string; that riser cap generally includes a fluid having a higher density as compared to the drilling mud, and which is used to adjust bottom hole pressure, to ensure it falls within an acceptable level. A user can calculate an amount of fluid that must be added to a riser cap 160 to arrive at a specific bottom hole pressure. If the fluid column expands, there will be a corresponding increase in bottom hole pressure, which could result in breaking the formation of rock or other material in the hold, leading to a loss of drilling mud that would otherwise return to the surface, but which instead escapes via the fractured rock formation. By way of contrast, if too little fluid is included at the riser cap 160, too low of a pressure will be present at the bottom hole, leading to possible influx within the hole. In other words, there will be inadequate drilling mud within the hole, and instead of drilling mud being drawn up the hole external to the casing 152, water will be drawn into the hole.

Additionally, within each segment of drill string 150, a slug 170 may be included. The slug 170, like the riser cap 160, is a higher-density fluid positioned within each segment of the drill string. However, the slug 170 is used to reduce the amount of fluid expelled on the rig floor at the time a segment of the drill string is removed from the overall drill string as it is withdrawn. The slug 170 pushes mud downward out of the pipe segments at the upper end of the drill string, keeping those upper segments, or stands, empty such that when disconnected from the drill string, fluid is not spilled on the rig floor. The slug, similar to the riser cap, affects bottom hole pressure. However, the slug 170 also affects a balance of pressures within and external to the drill string, so that collapse of the drill string under high subsurface pressure can be avoided. Details regarding monitoring and alerting as to problematic bottom hole pressure and pressure balancing are described in further detail below.

Figure 2:
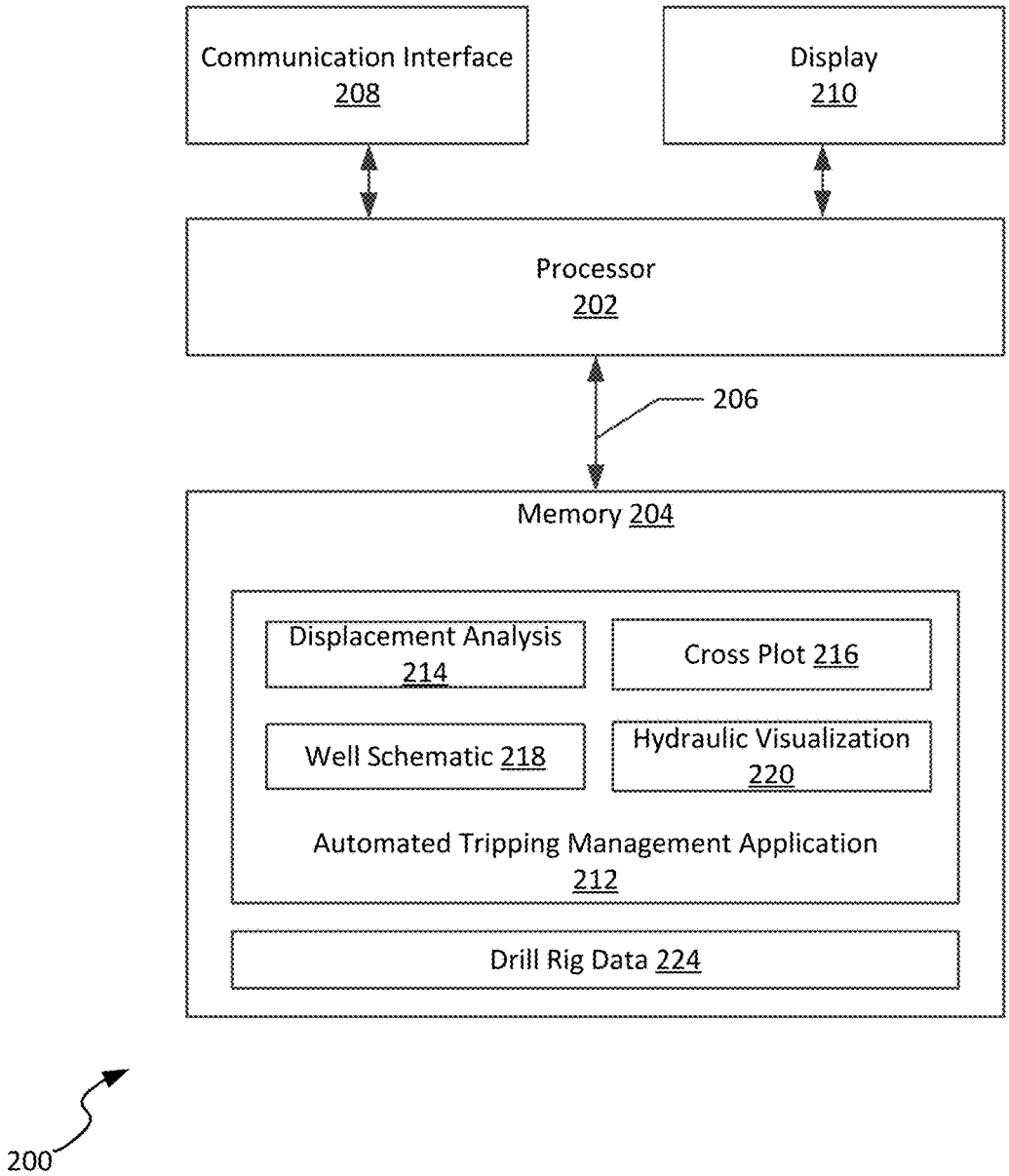
FIG. 2 is a schematic view of a system for automated well event detection and response, according to an example embodiment of the present disclosure.

Referring now to FIG. 2, details regarding a computing system 200 useable to implement the well event detection and response application described herein is disclosed. The computing system 200 can be used, for example, as computing system 105 of FIG. 1.

In general, the computing system 200 includes a processor 202 communicatively connected to a memory 204 via a data bus 206. The processor 202 can be any of a variety of types of programmable circuits capable of executing computer-readable instructions to perform various tasks, such as mathematical and communication tasks.

The memory 204 can include any of a variety of memory devices, such as using various types of computer-readable or computer storage media. A computer storage medium or computer-readable medium may be any medium that can contain or store the program for use by or in connection with the instruction execution system, apparatus, or device. By way of example, computer storage media may include dynamic random access memory (DRAM) or variants thereof, solid state memory, read-only memory (ROM), electrically-erasable programmable ROM, optical discs (e.g., CD-ROMs, DVDs, etc.), magnetic disks (e.g., hard disks, floppy disks, etc.), magnetic tapes, and other types of devices and/or articles of manufacture that store data. Computer storage media generally includes at least one or more tangible media or devices. Computer storage media can, in some embodiments, include embodiments including entirely non-transitory components.

In the embodiment shown, the memory 204 stores a well event detection and response application 212, discussed in further detail below. The computing system 200 can also include a communication interface 208 configured to receive and transmit data, for example to access data in an external database, such as database 104 of FIG. 1. Additionally, a display 210 can be used for viewing output of the well event detection and response application 212, for example by a realtime operator or a drilling site manager.

In various embodiments, the well event detection and response application 212 includes a displacement analysis component 214, a cross plot component 216, a well schematic generation component 218, and a hydraulic visualization component 220. Other components, or arrangements of functionality among components, could be used to implement the well event detection and response application 212 as well.

In addition to the components of the well event detection and response application 212, the memory 204 stores drill rig data 224, corresponding to data aggregated from one or more drilling rig sites 102*a-n* of FIG. 1. Details regarding the various types of drill rig data 224 are provided below in connection with the discussion of the analysis performed by the well event detection and response application 212.

In example embodiments, the displacement analysis component 214 calculates an actual displacement for each stand (e.g., segment) that is added to or removed from the drill string. In association with the displacement analysis component 214, one monitored feature of wellbore drilling relates to the volume of fluid (or its corresponding flow rate) that actually returns from the wellbore compared with the amount and/or rate at which mud is pumped into the wellbore. In a related manner, the volume of fluid in the wellbore during "tripping" operations to account for the volume of drill string inserted into the well or withdrawn from the wellbore is also monitored. The importance of the foregoing two comparisons is that imbalances in volume and/or flow rates into and out of the wellbore correspond to pressure control events, such as, for example, influx of fluid into the wellbore from one or more exposed formations; loss of fluid into one or more formations; and/or mechanical collapse of the wellbore. In this context, the actual displacement corresponds to an amount of drilling mud added to or removed from the drill string based on the change in drill string (to accommodate the length of the stand).

The displacement analysis component 214 is further useable to compare that actual displacement to a calculated displacement to determine if there is an over/under displacement on a per-stand basis. This calculation is measured taking into account the specific practices on the associated drilling rig, such as filling/emptying the trip tank while tripping. The displacement analysis component 214 also generates an alarm when the displacement trend changes and an over/under threshold for each stand is exceeded.

The cross plot component 216 generates multiple plots of information to be monitored by users of the well event detection and response application 212. In example embodiments, the cross plot component 216 can be used to plot a filtered hookload, and can compare a filtered hookload with a modeled hookload to determine deviations between those values. Generally, the cross plot that is calculated includes initial acceleration and deceleration, and comparison to a planned acceleration and deceleration or load determined from a model, as well as calculation of a running speed, and other operational parameters.

In general, the cross plot component 216 generates a user interface that allows an operator of the well event detection and response application 212 to view multiple plots within a single session to enable monitoring of several workflows concurrently. An example of such a user interface is presented and described below in connection with FIG. 3. Generally, plots can be automatically scaled and displayed with annotations, as illustrated in the examples below, to provide historical trends and current values of various drilling site data to allow a user to monitor various relationships among properties or subsystems of a drilling rig. Generally, at least a full day (24 hours) of rig data can be plotted for four or more curves, at a one-second granularity. One example of such a cross-plot is seen in the user interface 300 of FIG. 3.

Details regarding various components, and close-up views of various sub-portions of the user interface 300, are described in further detail below. However, generally the user interface 300 allows for plotting of multiple workflows and data sets to view overlaid correlations across data, and provide automated scaling of data to show relationships among data. The applied trip visualization display, or "trip sheet", as depicted by the user interface 300, enables the comparison and display of a visualization of the actual versus calculated displacement values and provides audible and/or electronic alarms for over/under displacement abnormalities that occur while tripping tubulars in and out of the hole. The trip sheet additionally may have the ability to visualize the actual versus planned hook load and alarm trend anomalies. Additionally, graphing historical data (e.g., from previous tripping analysis) relative to a current trip can be presented.

Figure 3:
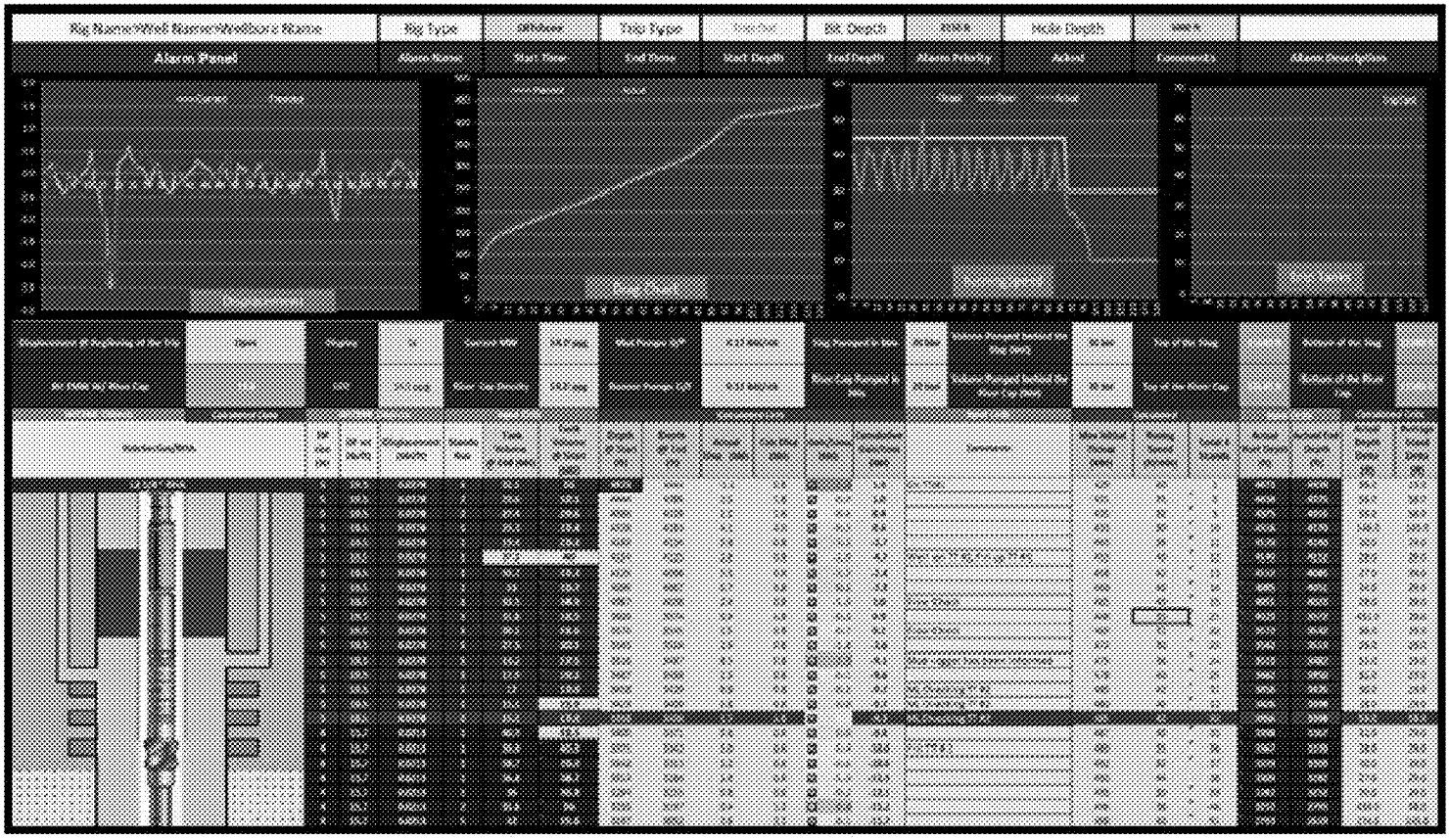
FIG. 3 illustrates a graphical user interface generated by the systems disclosed herein illustrating a dashboard useable by a realtime operator to view calculated data and alarms generated by the system for automated well event detection and response of FIG. 2.

As seen in the user interface 300 of FIG. 3, up to three separate graphs are depicted concurrently, as well as data tables. Each of the graphs and tables can depict various different monitored parameters of a drilling operation. In the embodiments of the present disclosure, the well event detection and response application 212 can combine and analyze all of this data concurrently using a set of developed rules to identify times at which well operation may require intervention or modification.

The well schematic generation component 218 generates and updates a graphical depiction of the well to illustrate its current operational status. The well schematic presents a visualization of a full well bore geometry as seen in FIG. 1A, above, and as such displays the riser including a boost line, choke line, and kill line, mudlog object data, and top and bottom level lines for both a riser cap and slug. One example well schematic 500 is provided below in connection with FIG. 5.

Figure 5:
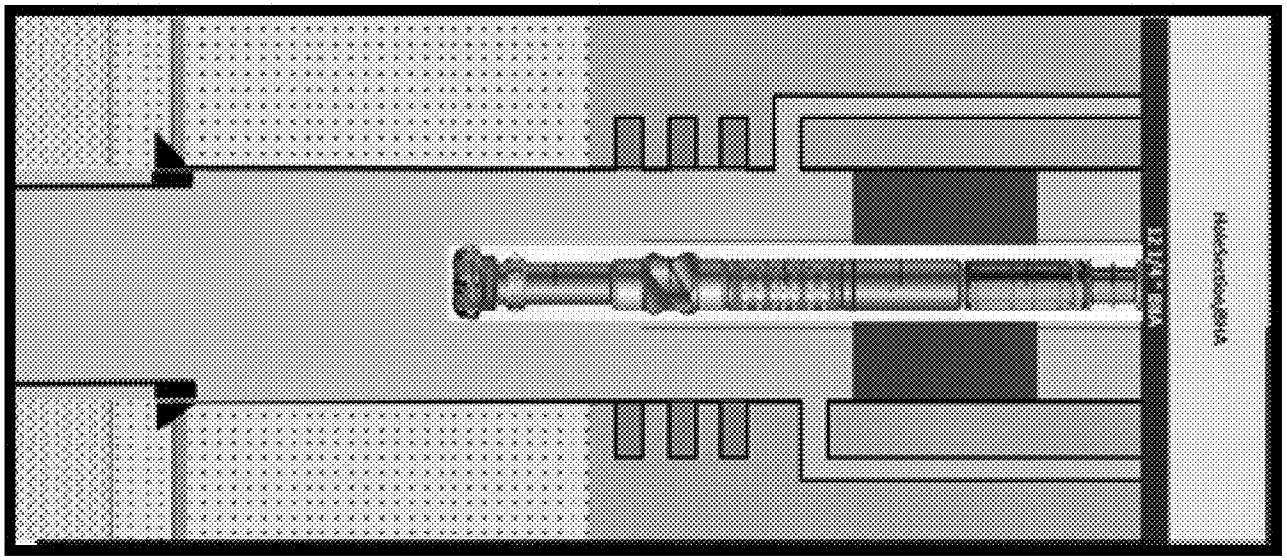
FIG. 5 is a schematic illustration of a downhole drilling mechanism illustrated in the graphical user interface of FIG. 3, according to an example embodiment.

As seen in FIG. 5, an example schematic illustration 500 of a well is provided, that illustrates the drilling mechanism 110 within that well, as depicted by the well event detection and response application 212. In the example shown, the well bore geometry is shown, including a graphical depiction of the BOP, riser cap and slug, within a general well schematic. Other details can be presented as well, such as mudlog object data, or descriptions of various components of the well.

Referring back to FIG. 2, the hydraulic visualization component 220 generates a visualization of the fluid interfaces in a wellbore, allowing for configurable combination of varieties of fluid (e.g., drilling mud, riser cap, slug, etc.) in well construction, and modeling of the effects thereof.

Figure 4:
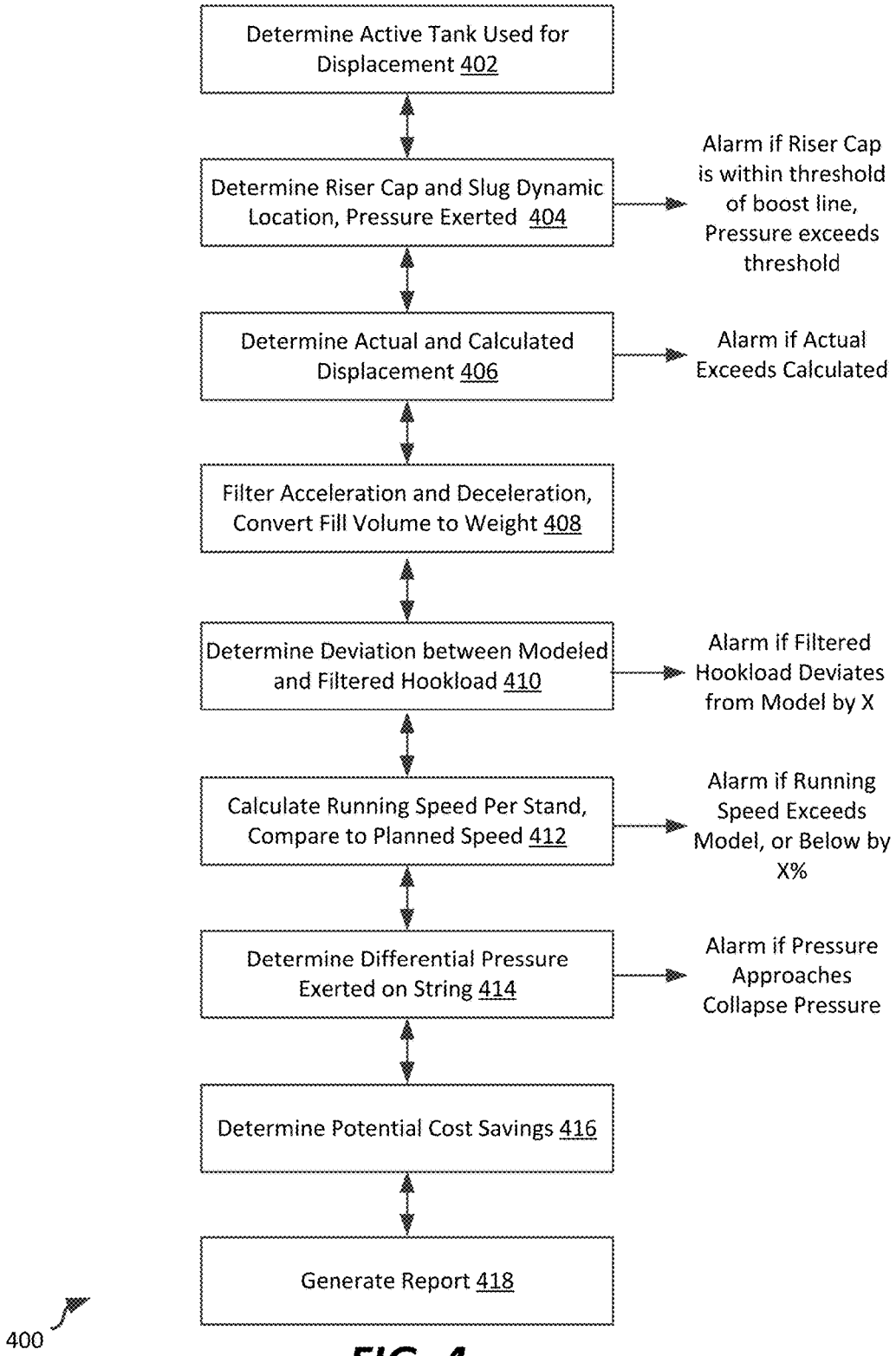
FIG. 4 illustrates a general method of operation of the system for automated well event detection and response, according to an example embodiment of the present disclosure.

Referring to FIG. 4, a flowchart 400 illustrating the general operational steps performed by the well event detection and response application 212 are provided. Generally, the flowchart illustrates operations performed by the components 214-220 of the well event detection and response application 212.

In the embodiment shown, the method 400 includes determining an active tank used for displacement (step 402) for example by determining the relative levels or change in levels of the tanks in the associated system. In general, a tank having decreasing volume, while other tanks are constant or increasing and the active system is constant or decreasing, is the active tank. However, if all tanks are constant or decreasing, the active system may be the currently active tank.

The method 400 further includes determining a location of the riser cap and slug (step 404) for purposes of thereby determining a bottom hold pressure. A detailed description of various scenarios for calculating the riser cap and slug location are provided in further detail below, and generally are based on accounting for volumes of areas within a riser, as well as within lines feeding to the riser. The method 400 further includes determining both an actual and calculated displacement (step 406), which corresponds to the operation of the displacement analysis component 214 above. The flowchart also compares a filtered hook load to a drilling model (step 408), which can be accomplished as shown by, for example, filtering initial acceleration and deceleration in a hookload while tripping and comparing that to planned hookload determined from an engineering desktop model for torque and drag features of the well. This can also include generation of alarms when the difference between actual and calculated torque (or drag) exceeds a user-defined threshold, or if a trend changes drastically over time.

As seen in FIG. 4 generally, alarms can be generated throughout the method 400 based on detection of a condition outside of a calculated or expected condition. For example, alarms can be generated if a riser cap is within a threshold distance from a boost line or if a bottom hole pressure exceeds a threshold in step 402, or if actual displacement exceeds calculated displacement in step 404.

The method 400 further includes determining a deviation between a filtered actual hookload and a modeled hookload (step 410) and issuing an alarm if the filtered actual hookload deviates from the model by a particular threshold. The method 400 further includes a calculation of a running speed and comparison to a planned running speed determined using the engineering desktop model (step 412), and generating an alarm if the running speed exceeds the modeled running speed, or falls below the modeled running speed by a predetermined threshold. Additionally, the method 400 includes determining a differential pressure exerted on the string (step 414), and alarm generation based on those pressures. For example, the method can be performed to alert users to prevent a drop in hydrostatic pressure and corresponding potential collapse in the drill pipe during tripping in a closed-ended mode. A closed-ended trip is generally a type of trip performed in which drilling fluid cannot enter the bottom of the drill string while tripping, and therefore returns up the drilled hole external to the drill string.

In addition, the method 400 can include calculation of cost savings (step 416), for example by determining a difference in an amount of mud pumped into a drill string under actual conditions as compared to the amount of mud that would have been pumped into the drill string based on standard decisionmaking (e.g., at a different speed based on hookload, pressure determined by alternative means) The method 400 also includes generation of reports (step 418), such as a full report of a trip, or sub-reports regarding specific analyses of operational parameters. The flowchart 400 also can include reporting of tool status, including display of real time data included in a data log. This can be performed using a widget displayed as part of a graphical user interface generated by the well event detection and response application 212. The display can also display various other data in association with tool status, such as a well name, well bore name, rig name, trip type, online or offline status of the application relative to operating drilling rigs, or other operational features of either the application 212 or associated rigs.

II. Graphical Features of Automated Well Event Detection and Response System

Referring now to FIGS. 6-26, details regarding subsections capable of inclusion in the graphical user interface 300 are described in greater detail, as well as operational details of the well event detection and response application 212, including various conditions under which automated alarming or event detection is performed. It is noted that a plurality of such graphical sub-sections can be presented within the graphical user interface 300 of FIG. 3 at the same time, allowing a user to view alerts regarding various different operational aspects of a well that is being operated or monitored.

Figure 6:
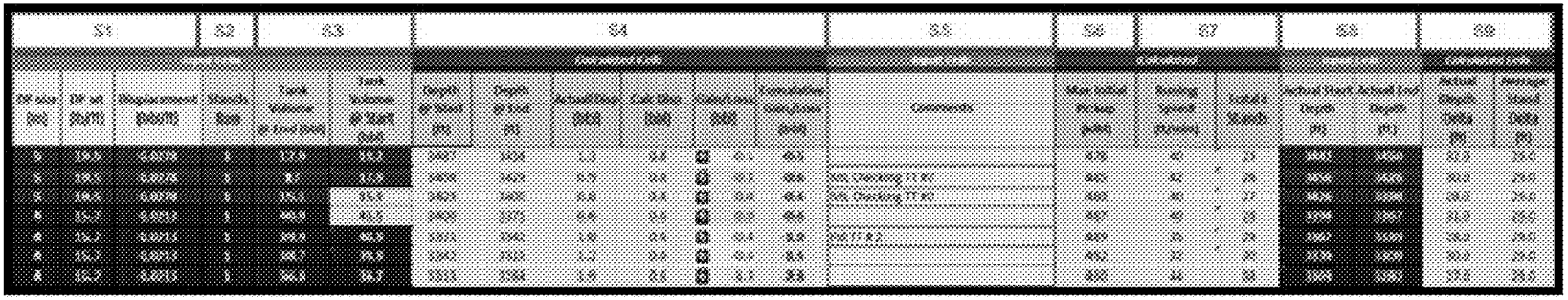
FIG. 6 is a schematic illustration of a table view included in the graphical user interface of FIG. 3 for calculation and visualization of displacement and running speed during tripping, according to an example embodiment.

As seen in FIG. 6, a table view 600 of displacement and running speed during tripping is displayed. In the table view, the various string components and associated displacement are displayed, alongside a number of stands/joints run or pulled to/from the well. In addition, a start and end volume of a trip tank can be displayed, alongside running speed for each stand and/or joint, and start/end depth, change in depth, and average stand information, among other features. For example, in addition to those show, maximum initial pickup weight, slack off weight, and torque per stand can be displayed. Optionally, a color coding of a row for each row is provided (each row representing a particular segment or stand being added or removed). Additionally, an alarm will sound when there is an anomaly in displacement and/or running speed of a drill string that is monitored.

Figure 7:
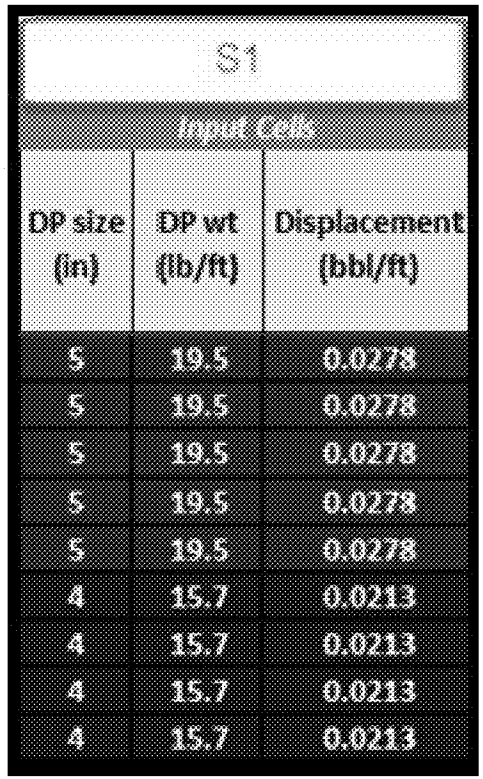
FIG. 7 is a table view of string component data useable within the graphical user interface of FIG. 3 to enter and display dimensions of drill string segments useable to calculate displacement features of a drilling mechanism, according to an example embodiment.

In FIG. 7, a string components section 700 is shown in which details regarding each drill string component are depicted. The string components section 700 allow a user to add or edit information regarding various string components to assist in calculation of displacement, by allowing for information regarding drill pipe size, weight, and displacement to be entered. Furthermore, in FIG. 8, a stands run section 800 displays a predefined or user-customizable list of the various stands and/or joints. In example embodiments, WITSML data for defining tubular and bottom hole objects can be read, and used for displacement calculations.

Figure 8:
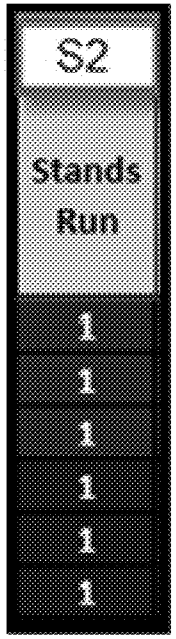
FIG. 8 is a table view of stands run and pulled data useable to monitor each stand during tripping within the graphical user interface of FIG. 3, according to an example embodiment.

It is noted that the data tracked in FIGS. 7-8 can be used, in connection with the present disclosure, to detect various tripping modes can be used, including a tripping in mode using trip tanks, a tripping out mode using trip tanks, a pumping in mode using active tanks, and a pumping out mode using active tanks, as well as an ability to determine which tank is an active tank during various activities. In example embodiments, a tripping mode can be detected using start and end depth calculations for a drill string. For example, when a difference between hole depth and bit depth is greater than stand length, and mud flow is below a user defined threshold (e.g., 10 gallons per minute), then a tripping in or tripping out operation is being performed using trip tanks. Active tank function is the function that determines if the trip is to be performed on trip tanks or the active system. If bit depth increase and mud flow is greater than a user-defined threshold, then the active tank is the active system and the trip mode is pumping in. Tripping in and tripping out can be distinguished by determining a difference in bit depth. For example, if a running sum of bit depth difference over a predetermined amount of time (e.g., over 5 or 10 minutes) is greater than a threshold distance (e.g., 3 feet), then tripping in is performed, and tripping out is performed if the running sums of bit difference are less than a decrease of 3 feet.

In some embodiments, specific times, hole and bit depths, block positions, and hookloads for each stand can be monitored, to allow for a determination of whether the stand was run or pulled. The bit depth might be adjusted on the rig site by the mudlogger to match the pipe tally. Advantageously, in one embodiment, the system has the ability to distinguish between bit depth increase/decrease and bit depth adjustment. In accordance with the following disclosure, markers can be generated to assist with an improved displacement calculation Advantageously, in one embodiment, the system has the ability to identify the bit depth adjustment by correlating the increase/decrease in bit depth with the decrease/increase in block position along with the slip status (e.g., in slips, off slips).

Figure 9:
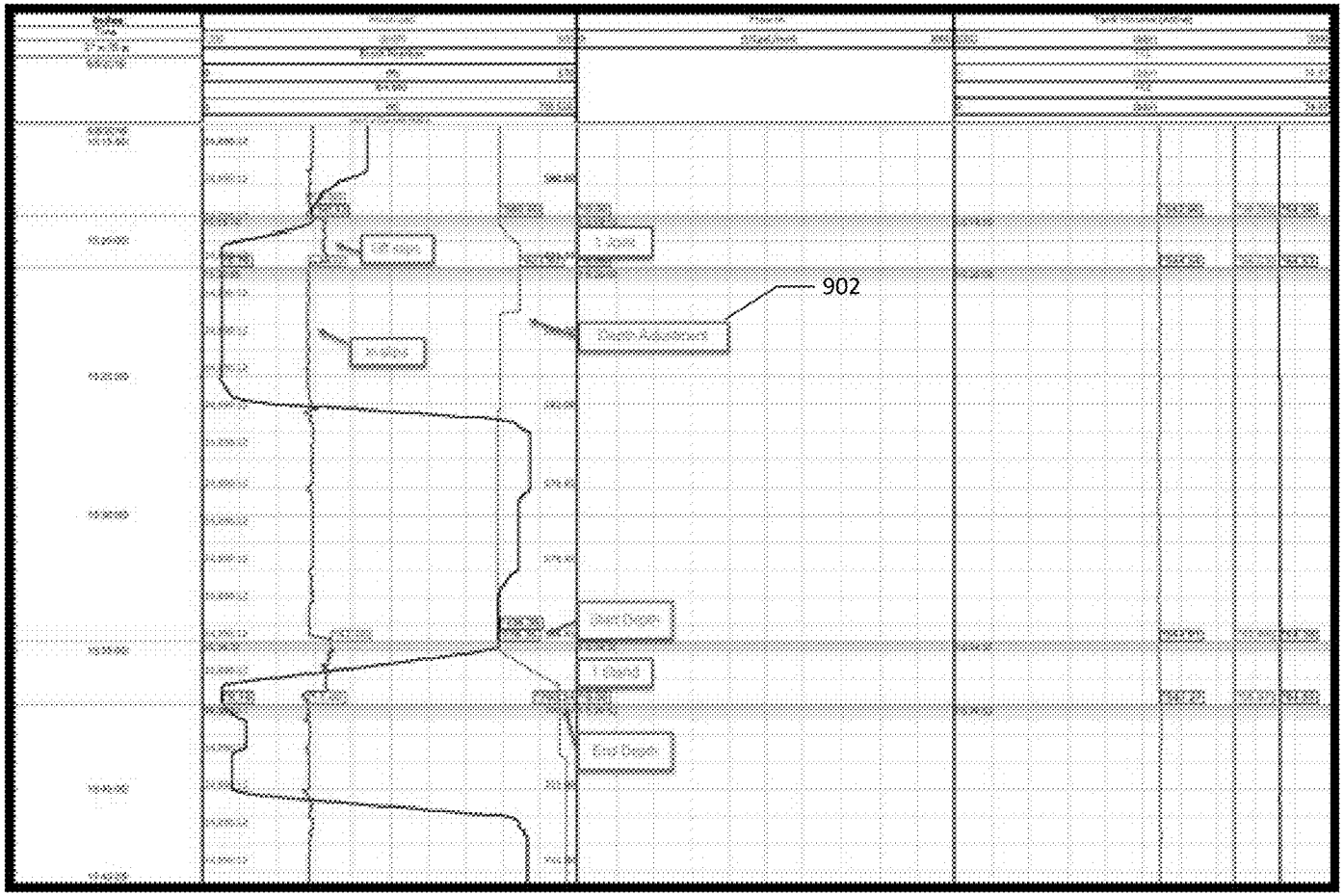
FIG. 9 is a graphical view of bit depth adjustment performed using the automated well event detection and response system of FIG. 2, while the drill string is in slips, according to an example embodiment.
Figure 10:
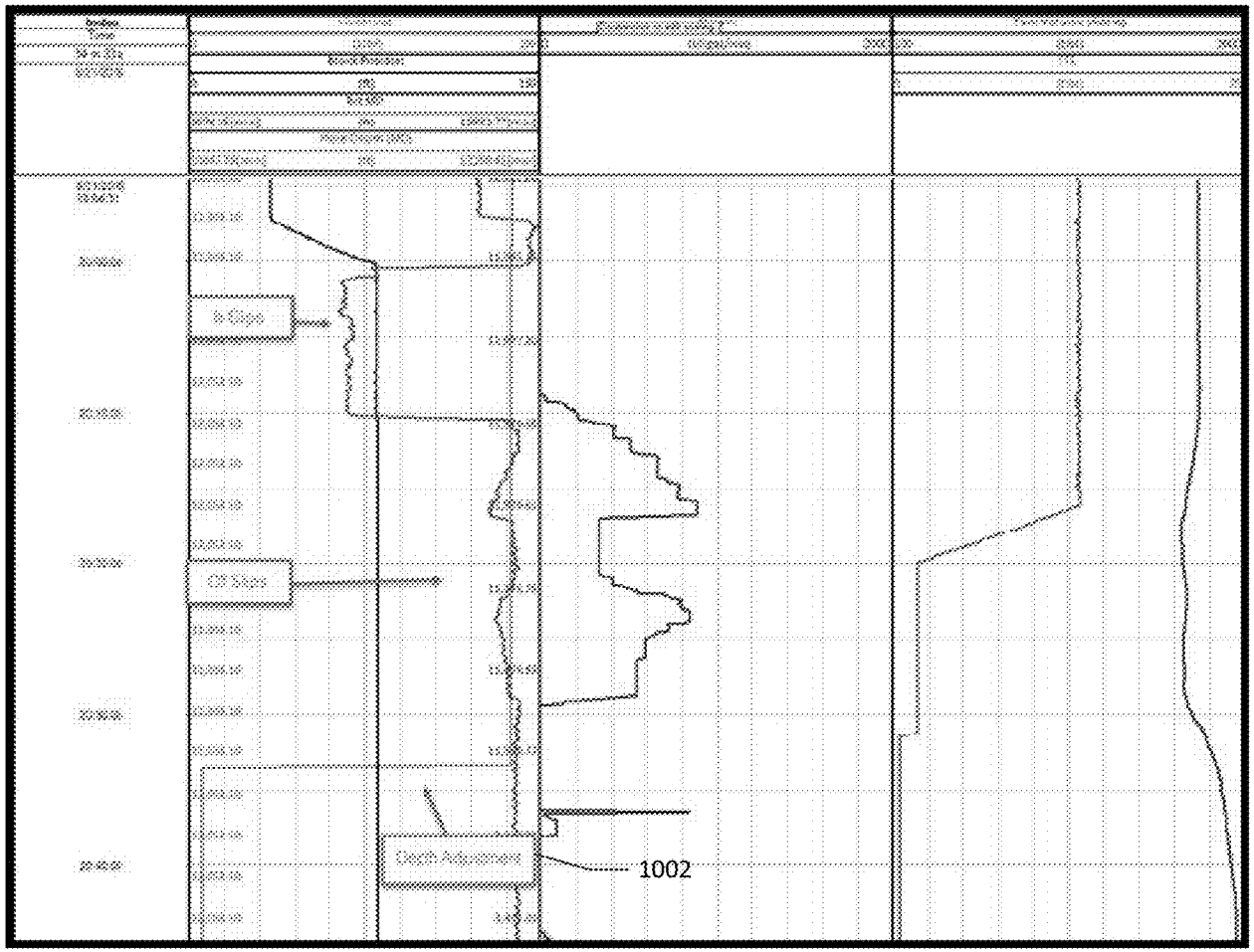
FIG. 10 is a graphical view of bit depth adjustment performed using the automated well event detection and response system of FIG. 2, while the drill string is off slips, according to an example embodiment.

As seen in FIG. 9, a graphical interface 900 depicts drilling data at various depths over time, and includes depiction of a bit depth adjustment 902 while the drilling mechanism is in slips (a device used to hold an upper part of the drill string with downward force toward the drill floor). The graphical interface 900 allows for depiction of a difference between pipe movements and bit depth adjustment when in slips, and illustrates distinction between the two to ensure accurate displacement calculations. In FIG. 10, the graphical user interface 1000 depicts drilling data at various depths over time as well, but includes a bit depth adjustment 1002 occurring while off slips (i.e., where that additional downward pressure is released). This illustrates a difference between pipe movements and bit depth adjustment when out of slips, for purposes of accurate displacement calculations.

Figure 11:
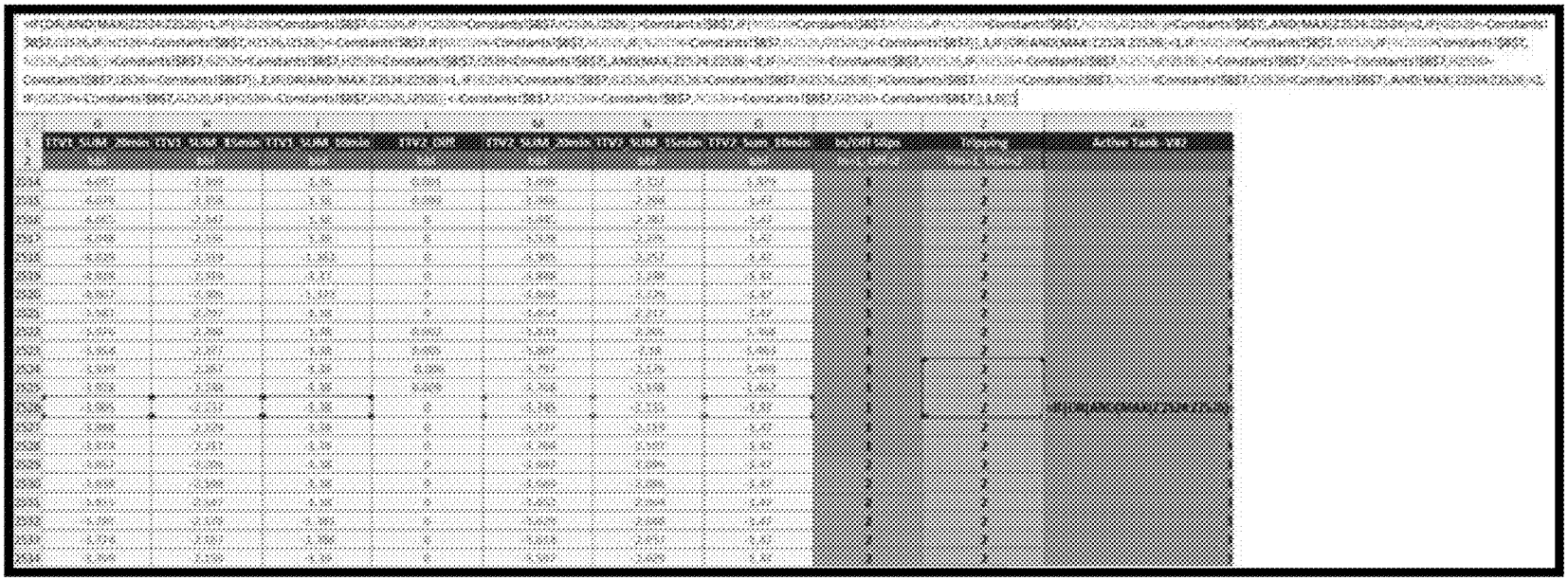
FIG. 11 is a table view of tank volumes monitored in various configurations by the automated well event detection and response system of FIG. 2, according to an example embodiment.

In addition to bit depth as illustrated above, the well event detection and response application 212 determines an active tank while tripping, from among a plurality of possible tanks that can be used. To do so, the application can determine if tripping or pumping is performed using a single tank or multiple tanks, and whether tripping is performed as part of an active system and whether tank pumps are on. To do so, a plurality of rules are applied based on the observed data relating to hole depth, bit depth, tank volumes, pits volumes and flow of drilling mud. As seen in FIG. 11 a table view 1100 is illustrated in which tank volumes are monitored in various configurations by the automated well event detection and response system of FIG. 2. The table view depicts various differences and sums in hole depth, bit depth, and stand length, and correlates with mud flow to determine specific trip types, showing logic for determining active tank activity.

In particular, in example embodiments a trip type can be determined to be one of tripping in, tripping out, or pumping in/out based on whether mudflow is greater than a threshold (e.g., 10 gal/min., indicating a pumping in/out operation) and whether a difference between hole depth and bit depth is greater than a stand length in combination with whether a running sum of bit depth is greater/less than a threshold (with lower running sum reflecting tripping out and higher running sum reflecting tripping in). Additionally, a specific active tank for tripping in/out can be determined if that tank is the only tank increasing (in the case of tripping in) or decreasing (in the case of tripping out), with the other tanks either being constant or operating inversely to the active tank.

In addition, use of such monitored values can allow the system to detect switching from one tank to another during operation, filling or emptying a trip tank while tripping, addition/removal of a pit from the active system, and distinctions between riserless and riser-included tripping.

Figure 12:
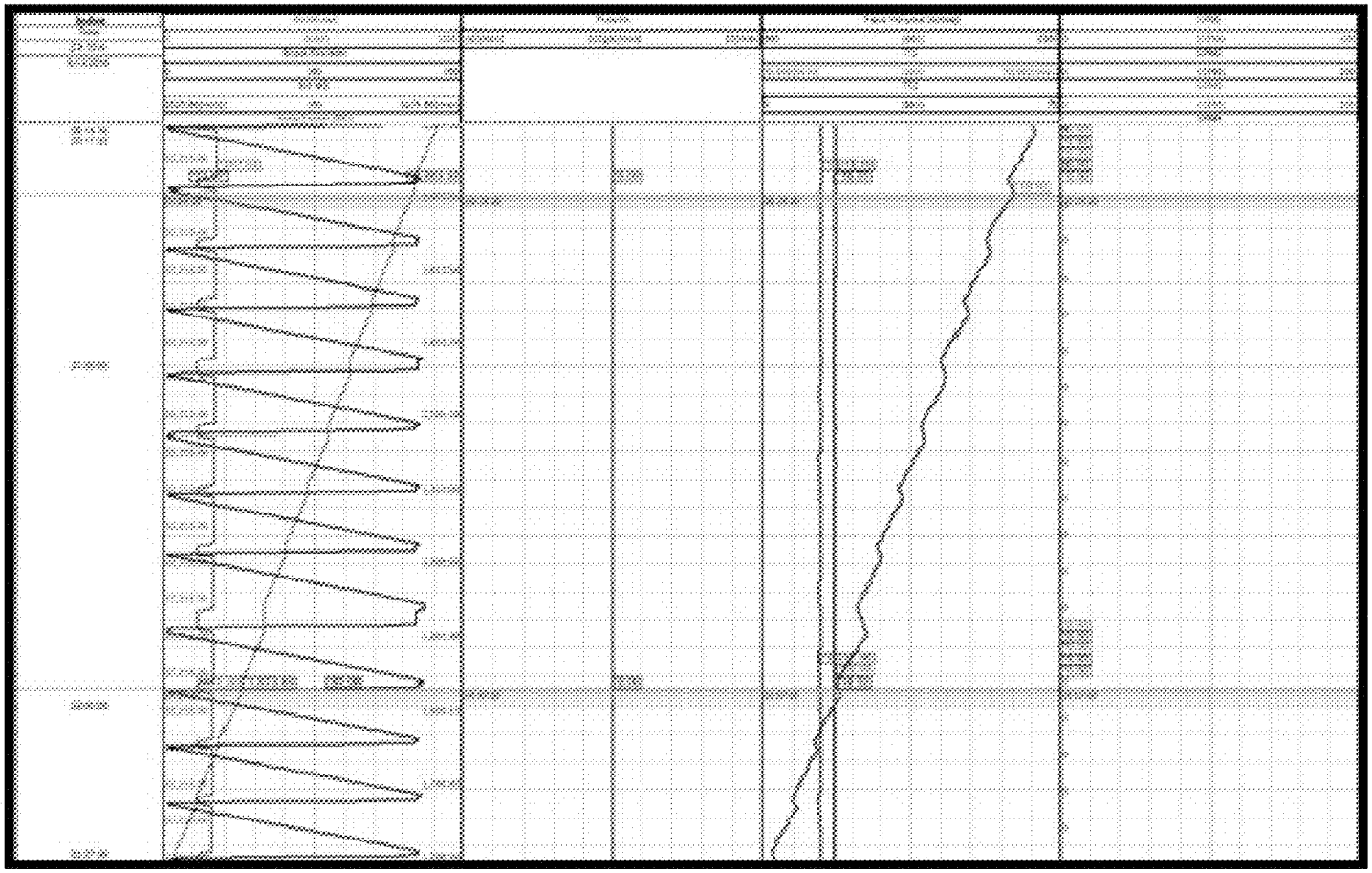
FIG. 12 is a graphical view of tripping out, according to an example illustration.
Figure 13:
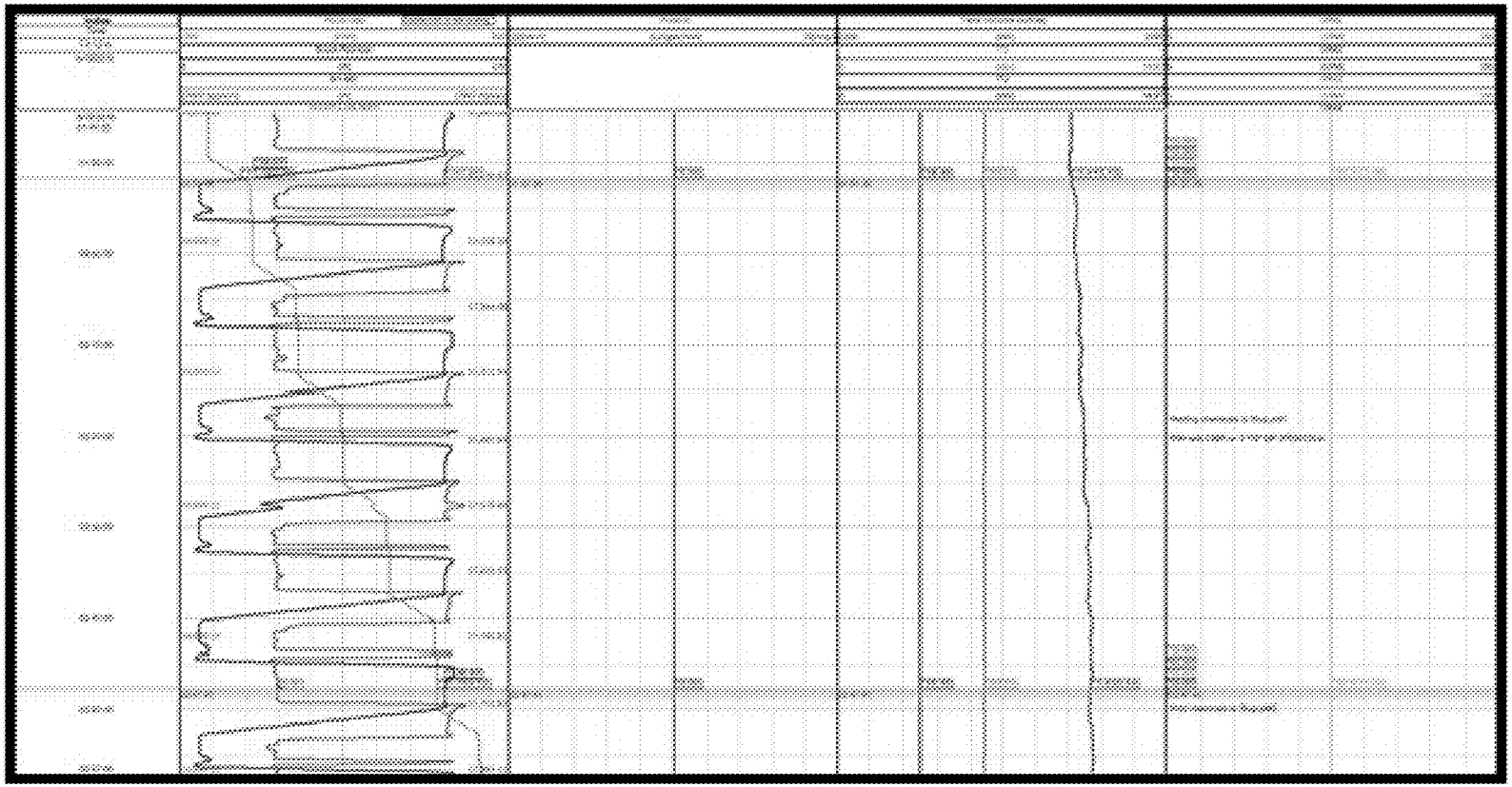
FIG. 13 is a graphical view of tripping in using an active system based on the data in the table view of tank volumes, according to an example illustration.

Providing still further illustrations of such tripping scenarios, FIG. 12 depicts a graphical view 1200 of tripping out based on the data in the table view of tank volumes. This illustrates an ability of the system to identify which tank is the active tank when calculating displacement, in particular when a single trip tank is used. In this example, tank volumes are decreasing over time for Tank 1, while other tanks remain constant. Additionally, the running sum of bit depth is showing a decreasing trend. By way of contrast, in FIG. 13, a graphical view 1300 of tripping in using a trip tank based on the data in the table view of tank volumes is disclosed. In FIG. 13, the bit depth is increasing, and tank volume increasing slightly, indicating a tripping in operation being performed. In this example, the trip is performed using the active system, but without any pumping operations being performed.

Figure 14:
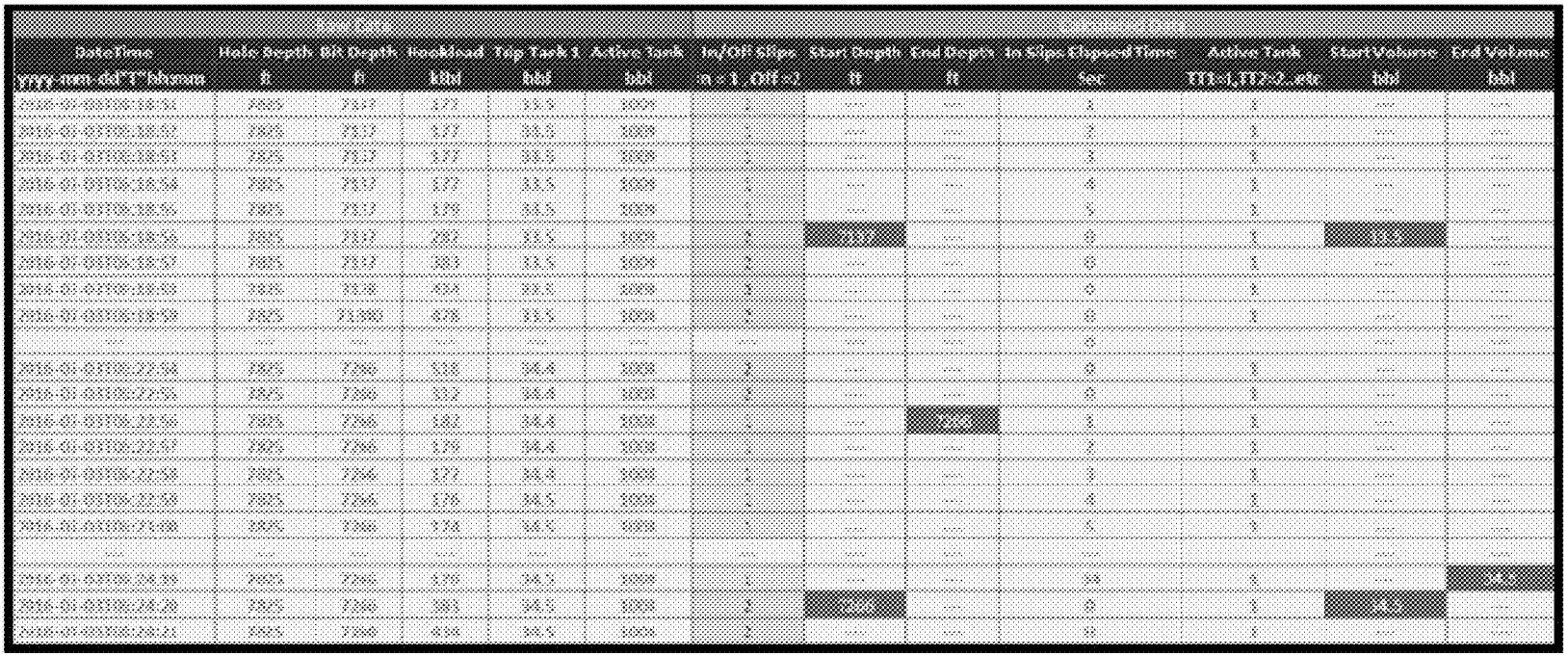
FIG. 14 is a table view illustrating calculation of start volume in a realtime data table included in the graphical user interface of FIG. 3, according to a possible embodiment of the present disclosure.
Figure 15:
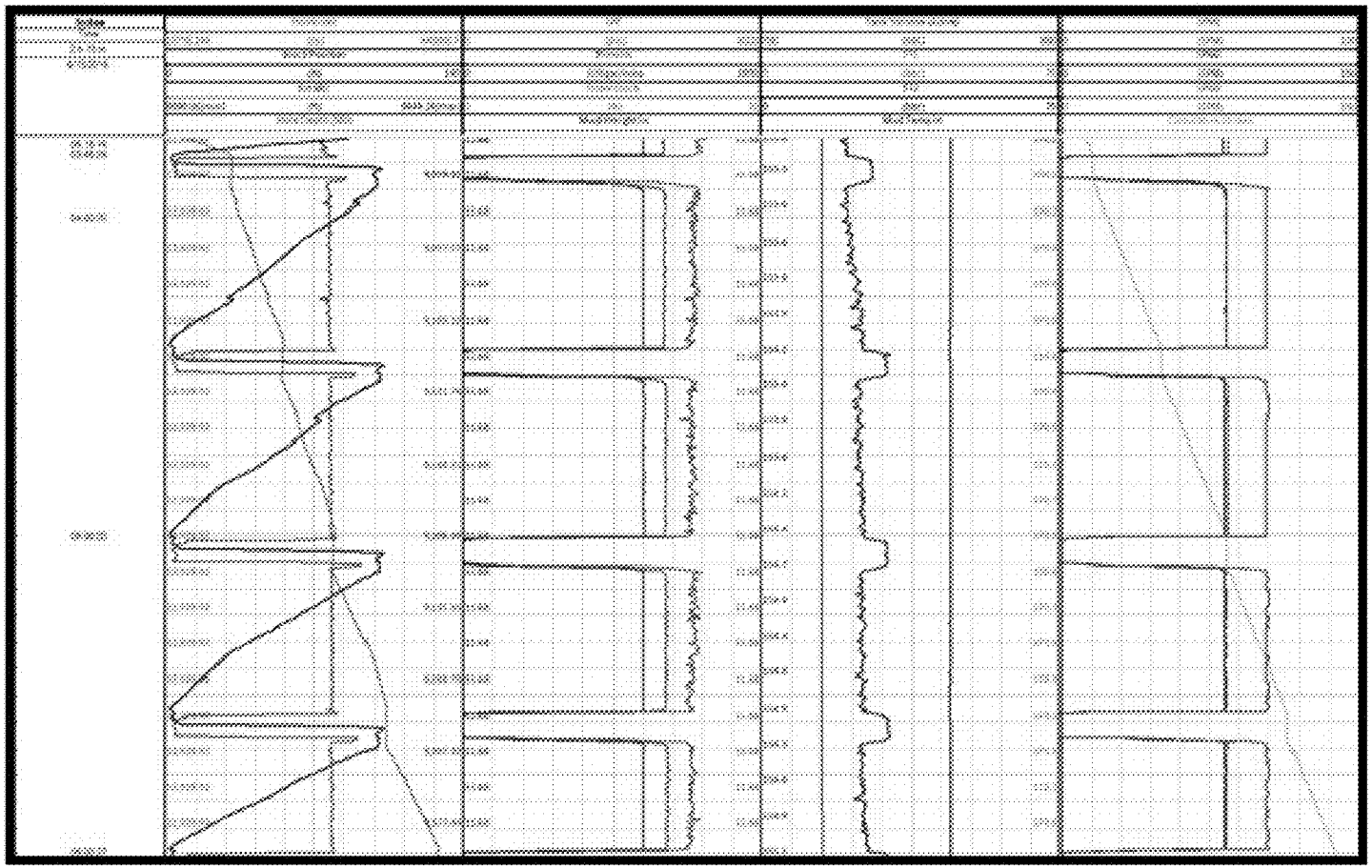
FIG. 15 is a graphical view of calculation of start volume based on the data in the realtime data table of FIG. 14 showing pumping activity, according to an example illustration.
Figure 16:
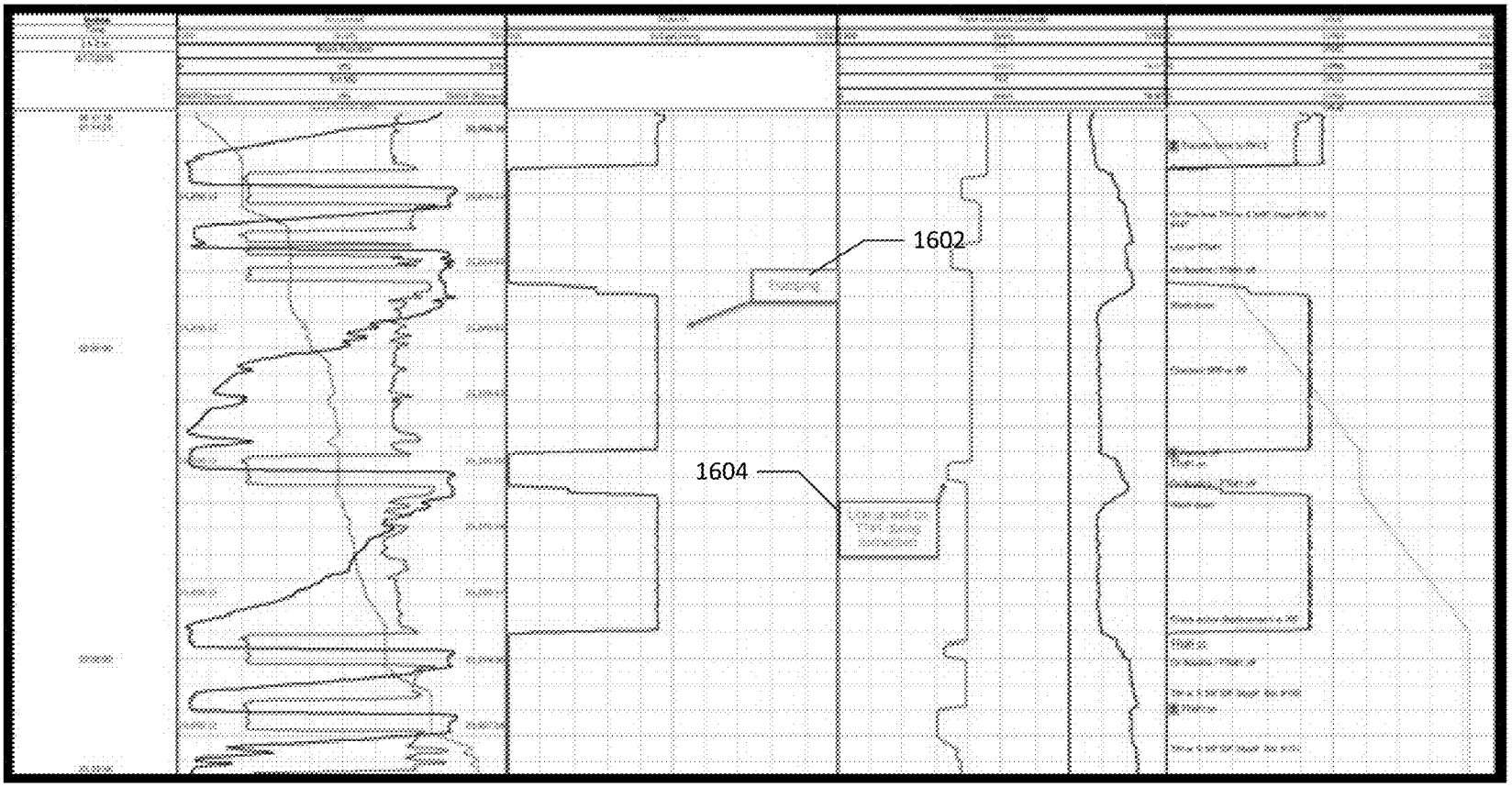
FIG. 16 is a graphical view of tripping using an active system with pumps on, according to an example embodiment.

In addition, once the active tank and mode are determined, a start volume per stand can be calculated based on volumes of drilling mud in the active tank(s). The start volume can be used, for example, in various other of the alerting calculations described in further detail below. An example of start and end depth calculations, as well as start and end volume calculations in an example tripping scenario is illustrated in a table view 1400 of calculation of such values as seen in FIG. 14. In that example, tripping is performed using the active system, rather than using a trip tank as described above. Furthermore, and as illustrated in the graphical view 1500 of FIG. 15, start volume can be calculated based one-hole depth, bit depth, trip type, and active tank volumes, according to example embodiments. In that example, pumping activity is shown. Referring to FIG. 16, a graphical view 1600 of tripping in using an active system with pumps on, and a trip tank used, is illustrated. This allows for a determination of when a well is lined up on the trip tank, which allows for calculation of displacement more accurately. In this example a pumping period 1602 is depicted, followed by an alignment operation 1604 with a trip tank.

FIG. 17 is a table view 1700 illustrating calculated start and end depth for each of a plurality of stands during tripping within a wellbore, displayed within the graphical user interface of FIG. 3. The table view 1700 illustrates the calculated depths used to calculate a theoretical displacement, for comparison to actual start and end depths as previously determined. To calculate start depth, at the beginning of the trip the calculated start depth is set equal to an actual start depth. Calculated end depth is set based on whether tripping or pumping in or out is occurring, and is based on the start depth plus the number of stands run multiplied by an average stand length.

In FIG. 18, a table view 1800 is presented showing actual and theoretical displacement. The theoretical displacement is determined for each pipe, and can be calculated using depth difference of the start and end depth for each stand, with the displacement based on the volume of each stand/joint. Actual displacement is simply a difference in start and end volumes for tripping/pumping. As further detailed in FIG. 19, a gain/loss and cumulative gain/loss table 1900 is depicted in which a running total of gain/loss is presented. The gain/loss for each stand is based on a difference between actual and theoretical displacement, with positive values representing gain and negative values representing loss. Based on gain or loss above a particular threshold, each stand may have an associated alarming level, as reflected in color coding associated with each stand entry. For example, a red entry may reflect a large gain/loss that may require user analysis, while a green entry may be within a threshold difference that might be considered acceptable, or within a margin of error.

Figure 21:
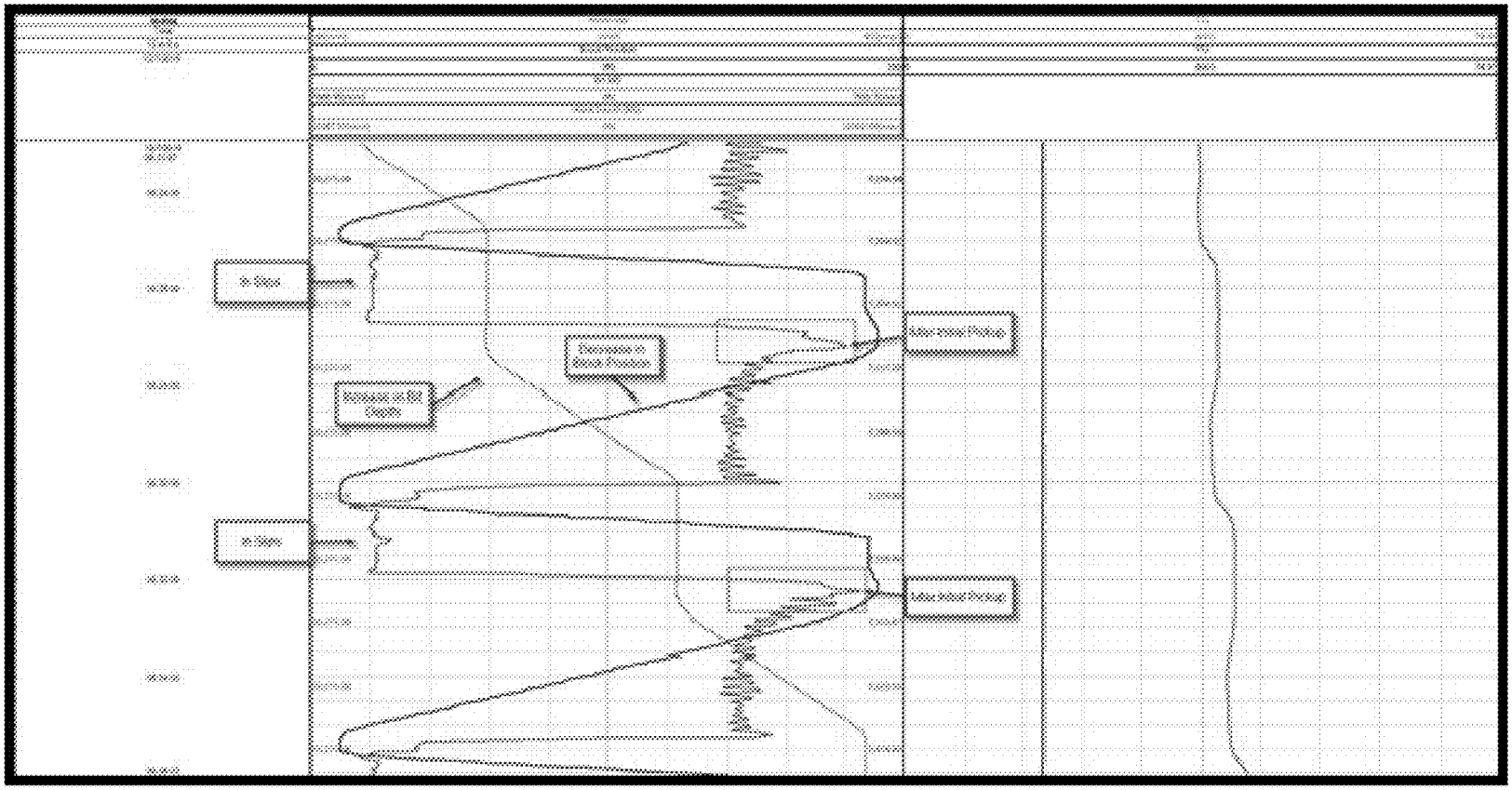
FIG. 21 a graphical view in which a maximum initial pickup is reached during tripping in, according to an example embodiment.

Referring now to FIG. 20, a table view 2000 of maximum initial pickup for each stand within a drill string, displayed within the graphical user interface of FIG. 3, according to a possible embodiment of the present disclosure. The table view displays data useable to generate smart alarms in the event of anomalous pickup for each stand. This refers to a maximum load noticed on a hookload indicator at initial picking up (e.g., within the first 15%) of the stand. As seen in FIG. 21, a graphical view 2100 is shown in which a maximum initial pickup is reached during tripping in, according to an example embodiment. In this arrangement, regions 2102 refer to instances of maximum initial pickup for each stand, and regions 2104 of the same hookload curve refer to when the drill string is in slips. A separate block position curve includes region 2106 illustrating a decrease in block position, while a bit depth curve 2108 illustrates increasing bit depth during the time when there is hookload, and the drill string is not in slips.

Figure 24:
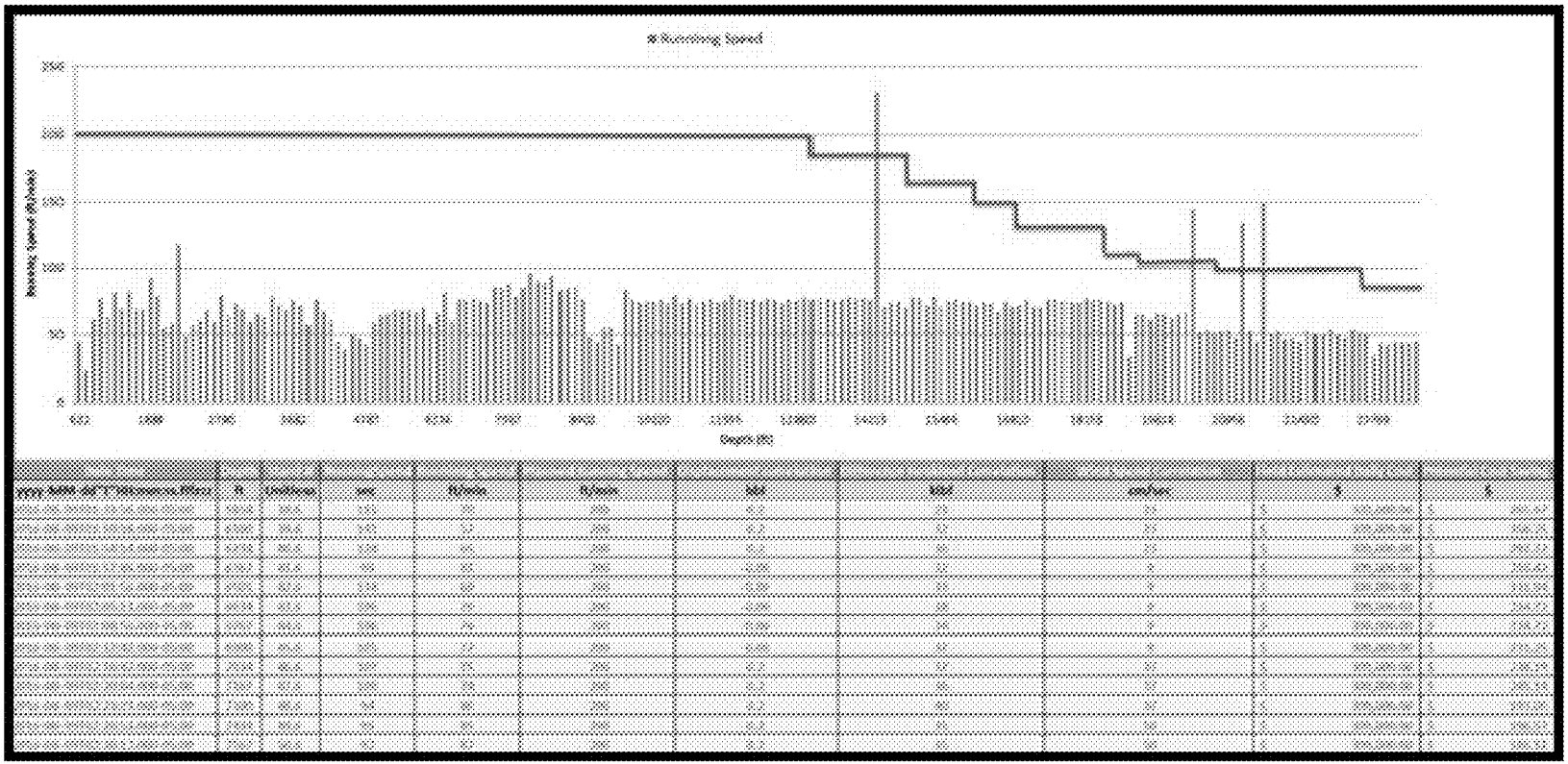
FIG. 24 is a graphical view illustrating monitored running speed relative to displacement, hookload, and windspeed, including cost considerations, within the graphical user interface of FIG. 3, according to a possible embodiment of the present disclosure.

FIG. 22 is a table view 2200 of running speed during each stand during tripping, displayed within the graphical user interface of FIG. 3, according to a possible embodiment of the present disclosure. In this example, the running speed is displayed on a per-stand basis using block position data. For example, the running speed determines the amount of time required to travel a particular distance downhole during tripping. FIG. 23 is a table view 2300 of a total number of stands included in a drill string, displayed within the graphical user interface of FIG. 3, according to a possible embodiment of the present disclosure. Referring to FIG. 24, a graphical view 2400 illustrates monitored running speed and modeled running speed relative to, e.g., displacement, hookload, and windspeed, including cost considerations, within the graphical user interface of FIG. 3. This allows the user to visualize calculated running speed as compared to a modeled running speed, for purposes of maintaining those two running speeds in close relation to maximize cost savings in terms of time and money per stand during operation of the drilling rig. As seen in the graph 2400, a planned running speed (seen as the horizontal line decreasing at increased depths) can be compared to detected running speed, both in terms of seconds per stand and feet per minute of vertical travel. The modeled (planned) running speed can be compared to determine a difference between the two, which represents possible cost savings that could be realized by maintaining a running speed at a particular level.

For example, in one embodiment, a modeled running speed is compared to a calculated running speed, and converted into potential cost savings with respect to costs of operating the drill rig. This can be performed, in such an example, by determining a hole condition by comparing a filtered hookload to a modeled hookload, to determine if that difference is below a user-defined threshold. Also, displacement from each stand is accounted for, as well as wind speed and an active tank trend. Based on these characteristics, a potential cost saving can be generated based on drilling speed, if the drilling speed can be optimized (e.g., increased or decreased) to speed tripping or to reduce loss of mud, depending on the particular situation at hand. In graph 2400, these parameters are tracked in a table view format, alongside a bar chart that displays the calculated and modeled running speed over the course of the trip.

FIG. 25 illustrates a table view for additional stand parameters that can be tracked and displayed using the graphical user interface of FIG. 3. FIG. 25 is a table view 2500 of a change in depth and stand length for every stand. In this example embodiment, the table view 2500 displays an actual depth delta, which is a difference between calculated start and end depths for each stand, as well as an average stand delta, which is the difference between the depths, and should correspond to a length of the stand for each stand.

Figure 26:
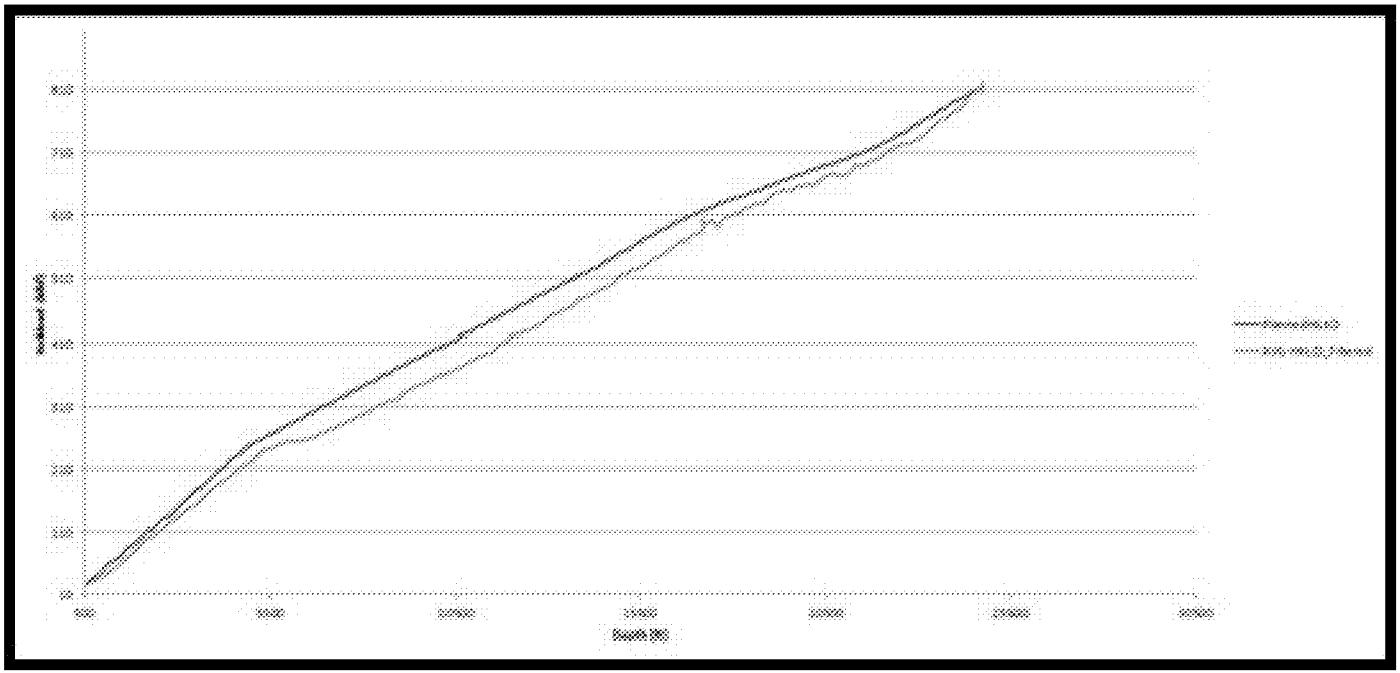
FIG. 26 is a graphical view of a drag chart used to monitor hookload relative to modeled hookload in the graphical user interface of FIG. 3, according to a possible embodiment of the present disclosure.

Referring now to FIG. 26 a graphical view 2600 of a drag chart is shown in the graphical user interface of FIG. 3, according to a possible embodiment of the present disclosure. The graphical view 2600 depicts divergence between actual hookload and modeled hookload, after filtering out the acceleration and de-acceleration in the actual hookload, to determine whether a higher than expected drag is being experienced by the drill string, which will allow a user to react and adjust drilling/tripping speed accordingly.

III. Automated Alarming Features of Automated Well Event Detection and Response System Referring now to FIGS. 27-42, various automated alarming features that can be integrated into the automated well event detection and response system described herein are provided. The alarming features can be generated using a well event detection and response application, such as well event detection and response application 212 of FIG. 2, to quickly notify a user of an anomalous event requiring attention, and which may require modified operation of a particular drilling rig during tripping. Example alarming features may be used to adjust a running speed and/or fluid levels to manage bottom hole pressure and avoid unsafe, damaging, or wasteful conditions that might occur in the wellbore.

Figure 27:
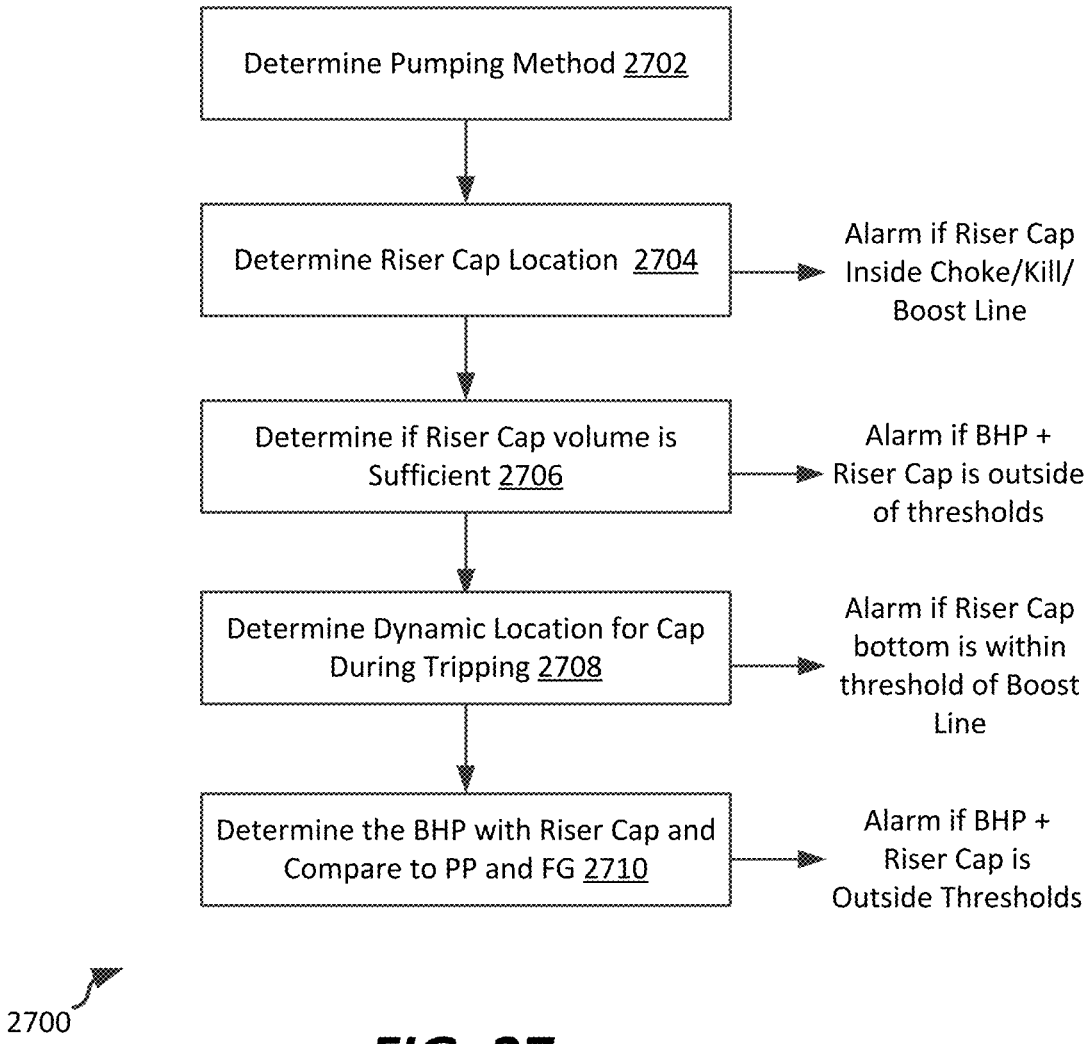
FIG. 27 is a flowchart of a method of calculating bottom hole pressure based at least in part on a riser cap position, executable within the automated well event detection and response system of FIG. 2, according to an example embodiment.

Referring first to FIG. 27, a flowchart of a method 2700 of calculating and alerting based on bottom hole pressure is illustrated. The method 2700 for calculating bottom hole pressure can be, as in the embodiment shown, based at least in part on a riser cap position, executable within the automated well event detection and response system of FIG. 2. The method 2700 can particularly be used in the event that conditions are static, i.e., when there are no pipe movements at an initial stage of pumping a riser cap. In such situations, it can be assumed that there are no static losses within the system.

In the example embodiment shown, the method 2700 includes determining a pumping method that is currently being used during a tripping operation (step 2702). The pumping method can be, for example, through a choke line or a kill line within a drilling mechanism.

The method 2700 further includes determining a riser cap location, including a location of a top and a bottom of the riser cap (step 2704). The method can include, in such a scenario, an alarm in the event the riser cap is within a boost line connected to the riser.

Figure 29:
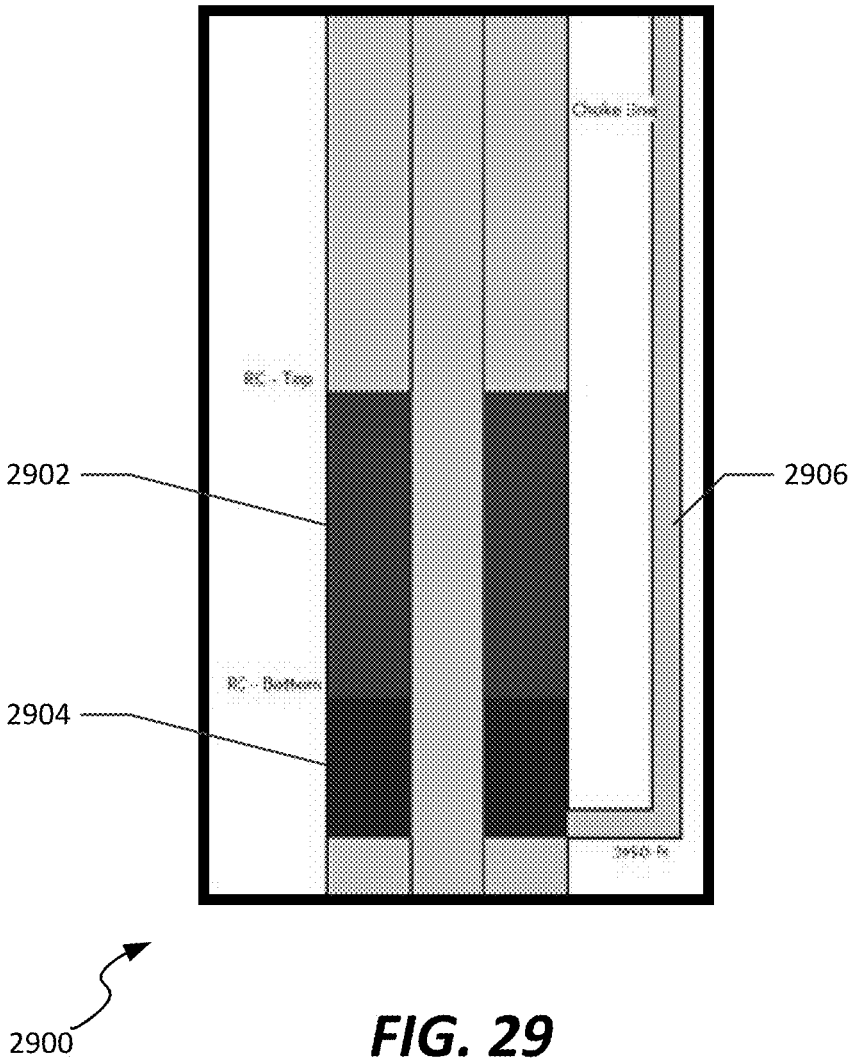
FIG. 29 is a schematic illustration of a riser cap position within the graphical user interface of FIG. 3, according to a possible embodiment of the present disclosure.

Based on a determination that a total volume behind the cap is greater than a total volume required to fill the like being used, a volume of the riser cap can be calculated. This can include determining a volume above a surface line inside the riser, and subtracting that from the total volume within the riser to determine the volume of the combined riser cap and mud behind the riser. In FIG. 29, the riser cap corresponds to region 2902 within that schematic 2900, and the mud behind the riser cap corresponds to region 2904.

Based on the volume of the riser cap and mud behind the riser cap, the levels for the top and bottom of the riser cap can be calculated. The top of the riser cap can be easily determined, but the bottom of the riser cap will be calculated. For example, a distance from the bottom of the riser cap to a flex joint length, subtracting a volume behind the riser cap and a capacity of a choke line (element 2906 of FIG. 29), can be divided by the riser capacity. The top of the riser cap can be calculated based on the bottom of riser cap, subtracting a volume of the riser cap inside the riser divided by the riser displacement with drill pipe.

Returning to FIG. 27, the method 2700 further includes determining if the riser cap volume is sufficient, e.g., for purposes of providing adequate bottom hole pressure (step 2706). The riser cap pressure corresponds to a difference between the top and bottom of the riser cap multiplied by the difference in mud weight between a riser cap weight and the original mud weight, multiplied by a constant (e.g., 0.052, in one embodiment.) In this situation, an alarm may be generated if the bottom hole pressure, as modified by the riser cap, is outside of a threshold (e.g., too high or too low). Of course, if the total volume behind the cap is not greater than a total volume to fill the line, then there is likely a problem within the drilling mechanism (e.g., a blockage within the choke line or kill line) and therefore another type of alert is generated.

In alternative situations, a riser cap position, and bottom hole pressure effect, can be calculated during operation of a booster pump, i.e., a dynamic cap position (step 2708). The booster pump being used can be identified, for example, by being a pump that does not have an effect on mudflow values when starting or stopping a pump. An alarm can be generated based on the dynamic location of the riser cap as well; details regarding such a calculation are provided in connection with FIG. 28.

Furthermore, a bottom hole pressure can finally be determined with the riser cap (during tripping), and compared to a pipe collapse pressure and an upper threshold (e.g., for breakout) to determine if a further alarm is to be enabled (step 2710).

Figure 28:
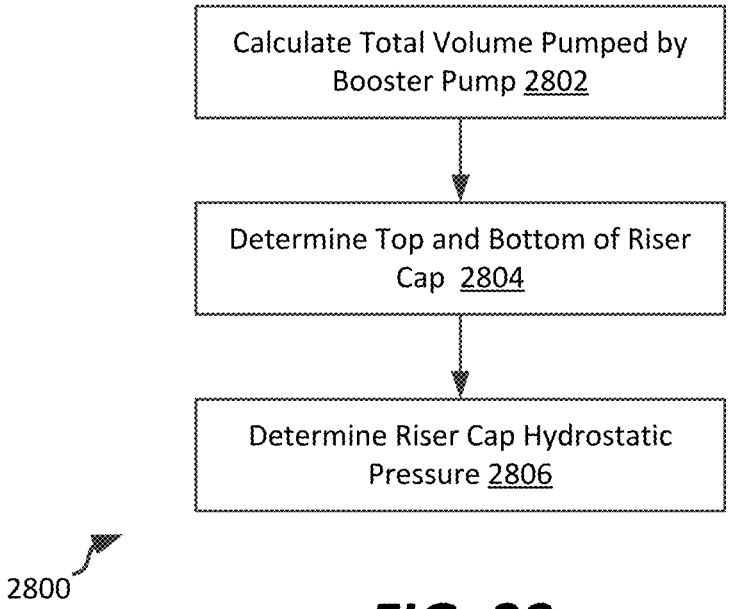
FIG. 28 is a flowchart of a method of calculating bottom hole pressure based at least in part on a riser cap position, executable using the automated well event detection and response system of FIG. 2, according to a second example embodiment.

In the case of dynamic position of the riser cap, and as illustrated in FIG. 28, a total volume pumped by the booster pump is determined (step 2802). A top and bottom of the riser cap can be determined (step 2804). This can include, for example, calculating a total volume pumped by a booster pump (e.g., accounting for a number of strokes pumped by a booster multiplied by a booster pump displacement), as well as determining that a bottom of the riser cap will be at the same position as a previous bottom position subtracted by the volume pumped by the booster pump, with a top position also being adjusted by the volume pumped by the booster pump.

Once the top and bottom positions of the riser cap are then determined, a bottom hole hydrostatic pressure can be calculated (step 2806). This corresponds to a difference between the top and bottom of the riser cap, multiplied by the difference in mud weight between the riser cap and the original mud weight, as adjusted by a constant as explained above in connection with FIG. 27.

Figure 30:
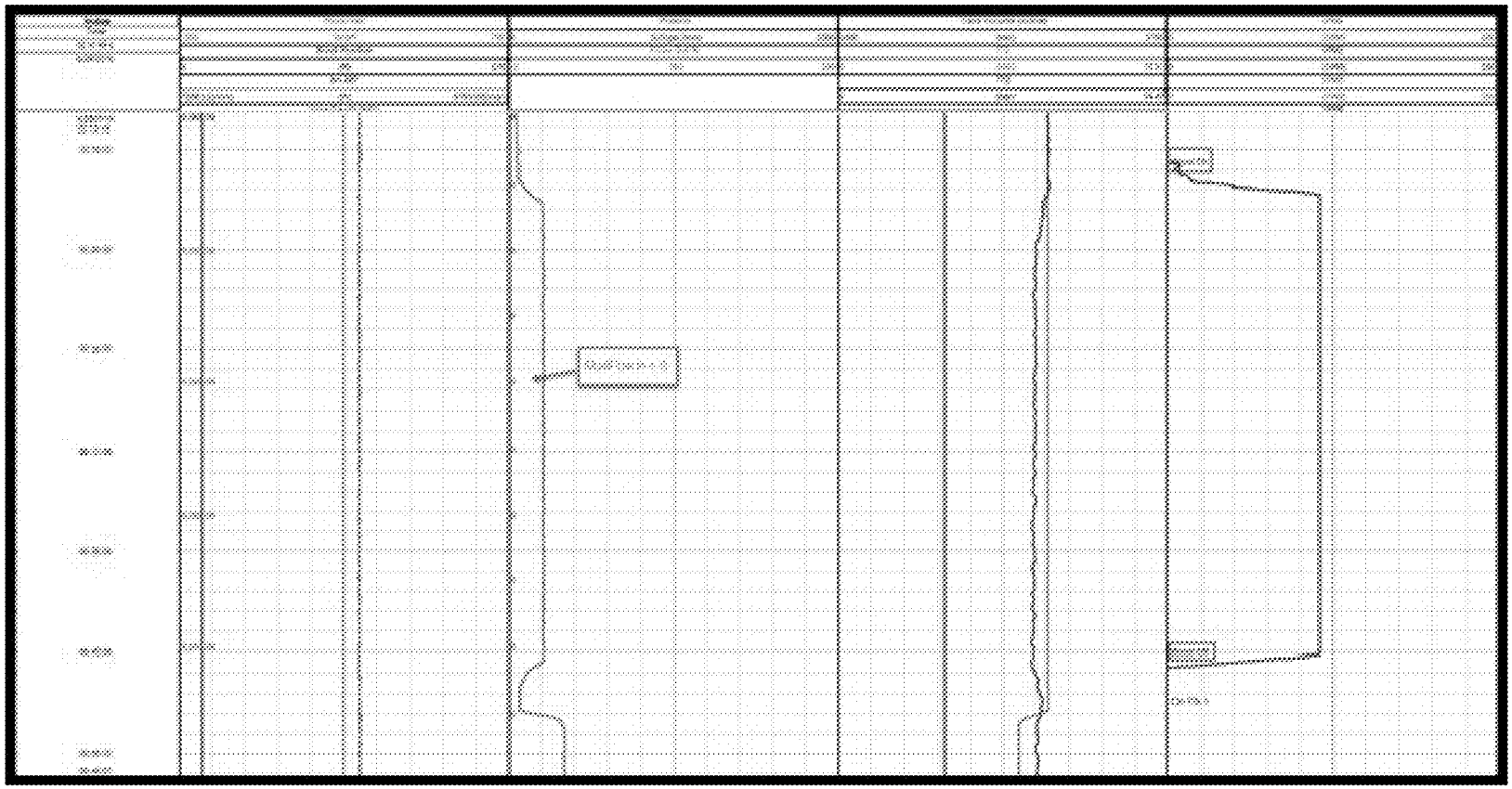
FIG. 30 is a graphical illustration showing a determination of a riser cap position while boosting the riser as displayed within the graphical user interface of FIG. 3, according to a possible embodiment of the present disclosure.
Figure 32:
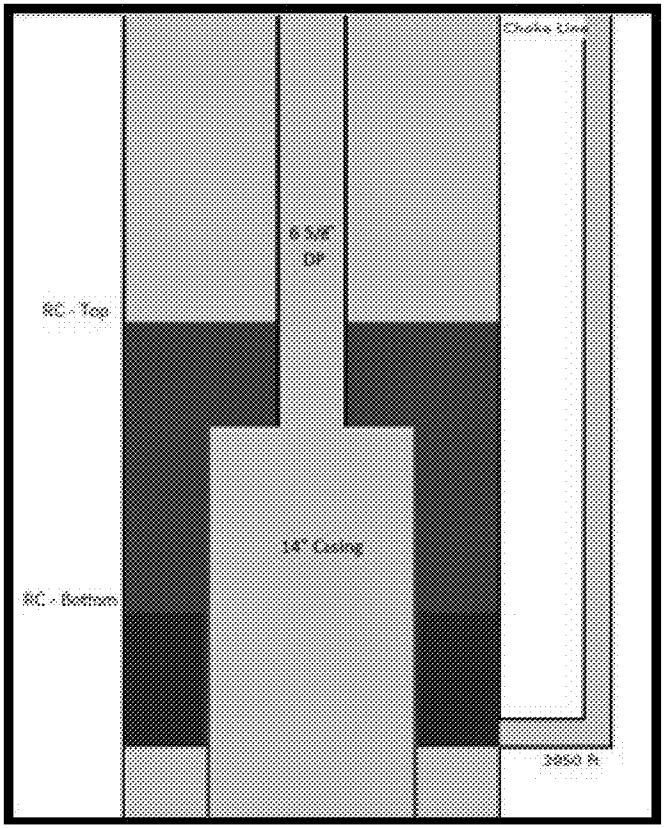
FIG. 32 is a schematic illustration of a third riser cap position within the graphical user interface of FIG. 3, according to a possible embodiment of the present disclosure.

As seen in the example chart of FIG. 30, a graph 3000 depicting operation of a booster pump is shown, in which a booster pump (referred to as "Pump 1" in the graph) is activated, causing mudflow out to occur at corresponding times. The booster pump operation and corresponding mudflow effects are used to determine riser cap positioning and corresponding bottom hole pressure, as explained above. The booster pump can be identified automatically.

It is noted that the methodology of FIG. 28 is also applicable when pumping with a rig pump rather than a booster pump; in such cases, the assessment of riser cap position will be adjusted based on characteristics of the rig pump (e.g., number of strokes and displacement) rather than the booster pump. Furthermore, in each of FIGS. 27-28, a riser cap position may be further adjusted if a stand or joint is pulled from the drill string. In such cases, the positions of the top and bottom of the riser cap will be adjusted based on the displacement of the drill string.

Figure 31:
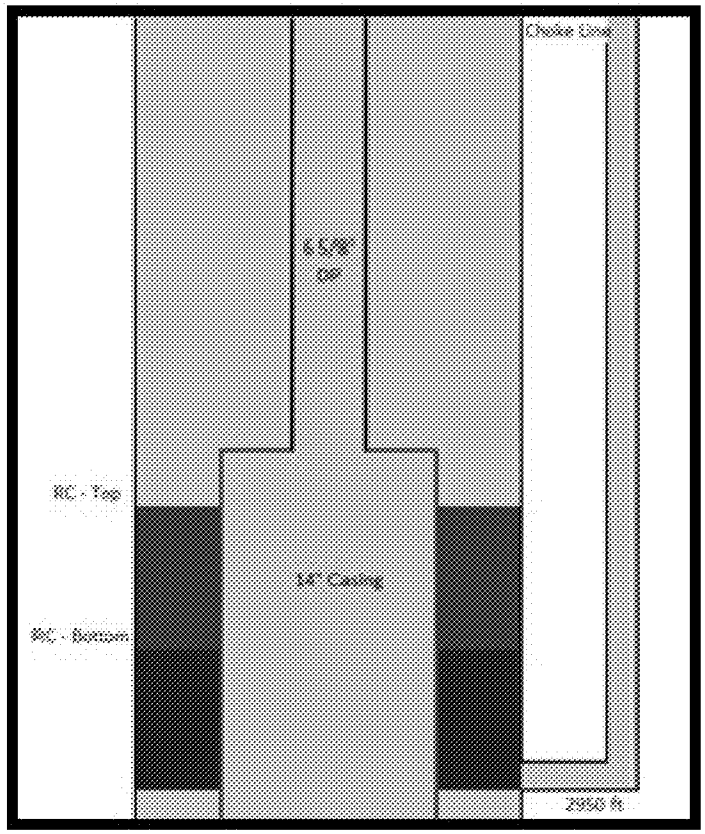
FIG. 31 is a schematic illustration of a second riser cap position within the graphical user interface of FIG. 3, according to a possible embodiment of the present disclosure.

In still further example arrangements, the riser cap may be calculated when there is no pipe movement, but in which there are multiple pipe sizes included in the drill string within the riser (e.g., as seen in schematic 3100 of FIG. 31). In such a scenario, a similar approach to that described in FIGS. 27-28 is used as well. In particular, a pumping method is determined, and a total number of strokes required to fill a choke line or kill line is determined based on the pumping method. If the total volume behind the riser cap is less than a total volume required to fill the line, an alarm will be generated. However, if the total volume pumped behind the riser cap is greater than a total volume required to fill the line, then the total volume pumped inside the riser and choke line is calculated, with the total volume within the riser corresponding to this volume, subtracting the volume of the choke or kill line previously calculated. A volume of mud behind the riser cap within the riser can then be calculated. This can be performed by calculating the total volume inside the riser and choke line, subtracting a choke line volume, and then calculating a volume of mud behind the riser cap within the riser. Once that volume is determined, a position of the bottom and top of the riser cap, and associated depth, can be calculated. This can be performed, for example, by determining if the casing top depth is less than a difference between a first distance between the Rotary Kelly Bushing (RKB) (e.g., at the junction between two stands) and the flex line and a second distance corresponding to the height of the mud behind the riser cap, then the top of the riser cap will be that same depth position, and the bottom of the riser cap is at the RKB to flex line depth subtracted by the volume behind the riser cap inside the riser divided by displacement between the riser and casing. However, if the top of the casing is above the RKB to flex line distance subtracted by the combined depth of the riser cap and mud behind the riser cap (e.g., as seen in schematic 3200 of FIG. 32), then the relative positions of the top and bottom of the riser cap are affected by the difference in displacement of the two stand sizes in the area of the riser cap, resulting in a difference in bottom hole pressure caused by the riser cap.

Figure 33:
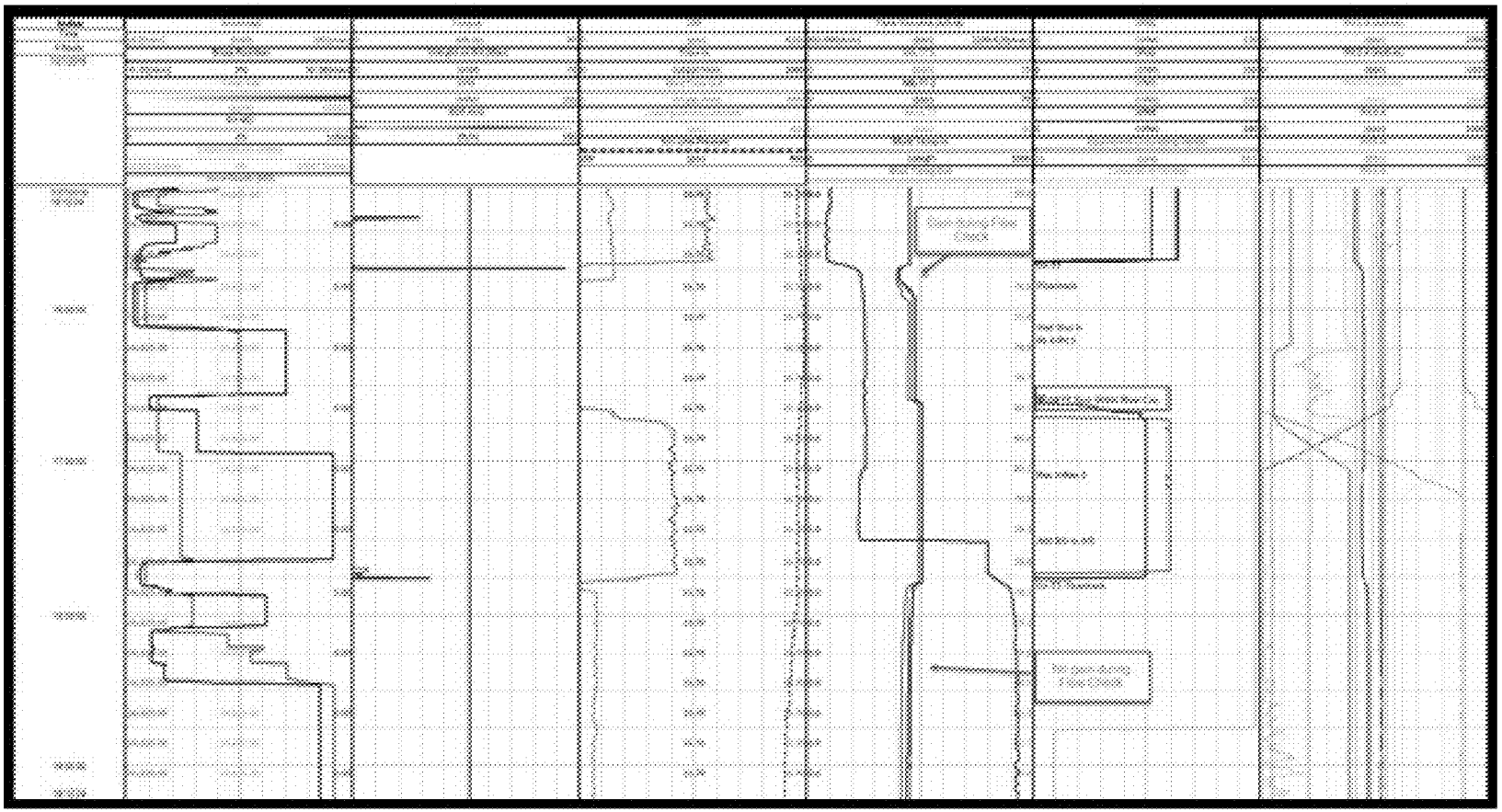
FIG. 33 is a graphical view of a scenario in which a riser cap is pumped during tripping in, in the graphical user interface of FIG. 3, according to a possible embodiment of the present disclosure.
Figure 34:
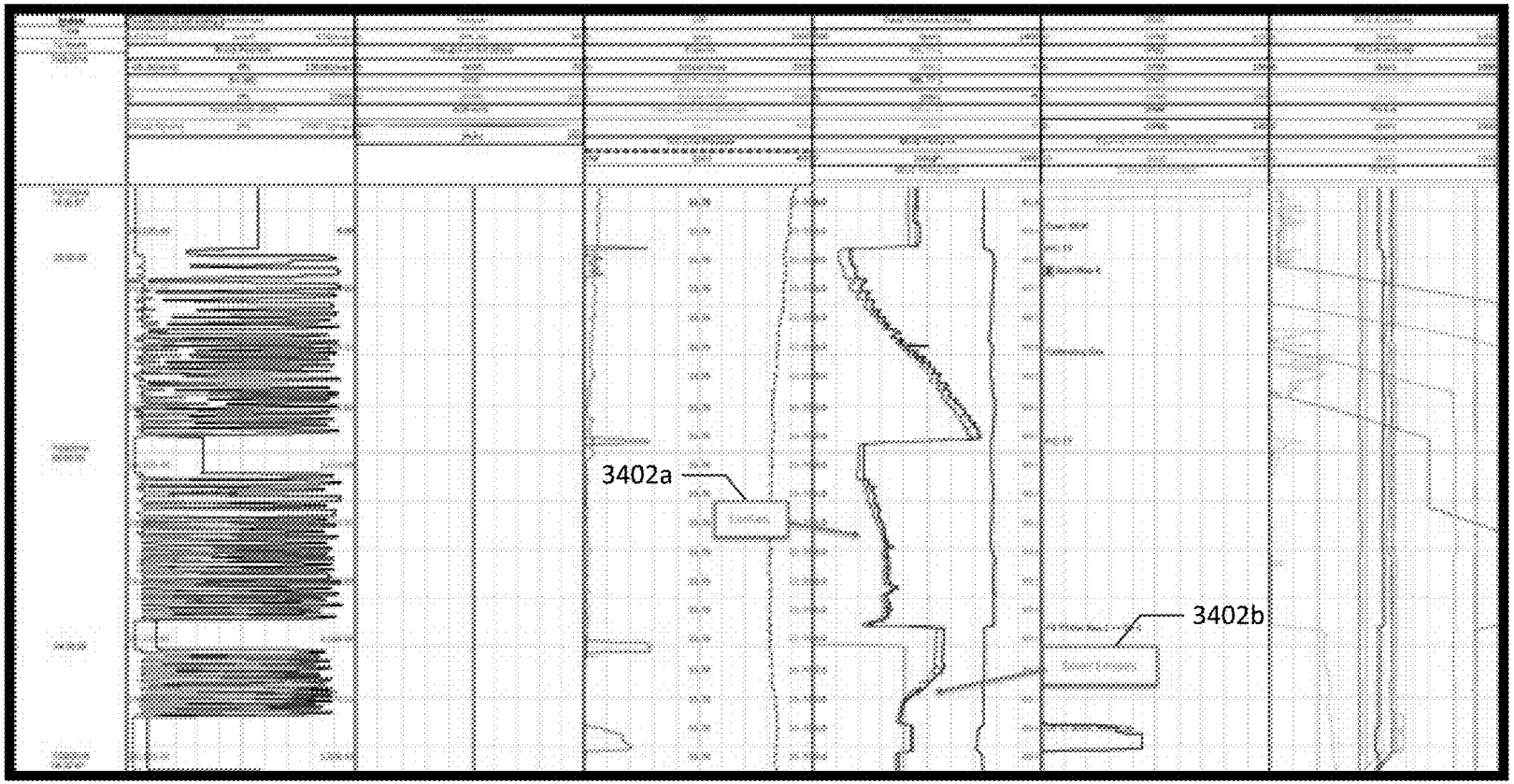
FIG. 34 is a further graphical view of a scenario in which a riser cap is pumped during tripping in, in the graphical user interface of FIG. 3, according to a possible embodiment of the present disclosure.

As seen in FIGS. 33-34, a particular example of calculating a riser cap position and corresponding bottom hole pressure is described, according to a possible embodiment of the present disclosure. In FIG. 33, a graphical view 3300 illustrating a scenario in which a riser cap is pumped during tripping in is shown. In this specific example, the well shut in and 385 barrels of 17.7 pound-per-gallon (ppg) mud was pumped into the riser cap. In this example, no gain in overall mud volume was noticed during a flow check after pumping the riser cap. A current mud weight of 15.7 ppg was reflected, with a total depth of 24624 ft, and Formation integrity test 15.72 ppg. In this scenario, water depth is 4235 ft, and a riser length of 4305 ft. was used. The riser has a capacity of 0.3599 bbl/ft, and a 6" boost line having a length of 4308 ft. is used, with a surface volume of 14 bbl. Accordingly, in this example, a riser cap height within the riser, and corresponding positions of the riser cap and bottom hole pressure, can be calculated as follows:

1. The Total Volume Inside the Riser.

$$\text{Total volume inside the riser} = \text{total volume pumped (bbl)} - \text{surface volume (bbl)} - \text{total capacity of boost line (bbl)} = 385(\text{bbl}) - 14(\text{bbl}) - 150(\text{bbl}) = 221 \text{ bbl.}$$

2. Top of the Riser Cap $$\text{With no pipe inside the riser, the top depth corresponds to a top of the riser cap with no pipe} = \text{boost line length} - (\text{Total volume inside the riser/Riser Capacity with no pipe}) = 4308 \text{ (ft)} - (221(\text{bbl})/0.3599(\text{bbl/ft})) = 3694 \text{ ft.}$$

3. Bottom of the Riser Cap

In this example, 150 bbl of the riser cap fluid is included inside the boost line.

4. Pressure exerted by the Riser Cap above Mud Weight $$\text{Pressure exerted by the riser cap} = \text{height of the riser cap (ft)} * 0.052 \text{ (based on size characteristics of the riser cap)} * (\text{riser cap density (ppg)} - \text{mud weight (ppg)}) = 3694 \text{ ft} * 0.052 * (17.7 \text{ ppg} - 15.7 \text{ ppg}) = 384 \text{ psi}$$

5. Bottom Hole Pressure (BHP) with Riser Cap $$BHP \text{ with riser cap} = \text{hydrostatic pressure of the mud column} + \text{riser cap exerted pressure (psi)} = 0.052 * \text{total depth} * \text{mud weight} + \text{riser cap exerted pressure (psi)} = 0.052 * 24624 \text{ ft} * 15.7 \text{ ppg} + 384 \text{ psi} = 20487 \text{ psi which equal to } 15.9 \text{ ppg}$$

6. Top of the Riser Cap After Running 2111 ft of 14" Liner (79.3 bbl)

$$\text{top of the riser cap after tripping} = \text{top of the riser cap before} - (\text{actual displacement volume/riser cap capacity})$$

Referring now to FIG. 34, a graphical view 3400 is provided that is further to the example of FIG. 33, in which a riser cap is pumped during tripping in. In the graphical view 3400, it is apparent that drilling mud losses occur during tripping in (at annotated portion 3402*a-b* of graphical view 3400). In this example, it can be seen that in periods where tripping in is occurring (illustrated by changes in hookload and block position), trip tank volumes will change as mud is delivered to or returned from the wellbore; however, in the sections 3402*a-b* in which losses occur, the same correlation between tripping and mud volumes degrade. In this example, the losses of drilling fluid during tripping occurred due to an increase in BHP, in turn due to riser cap expansion, which caused a break down in the formation.

Figure 35:
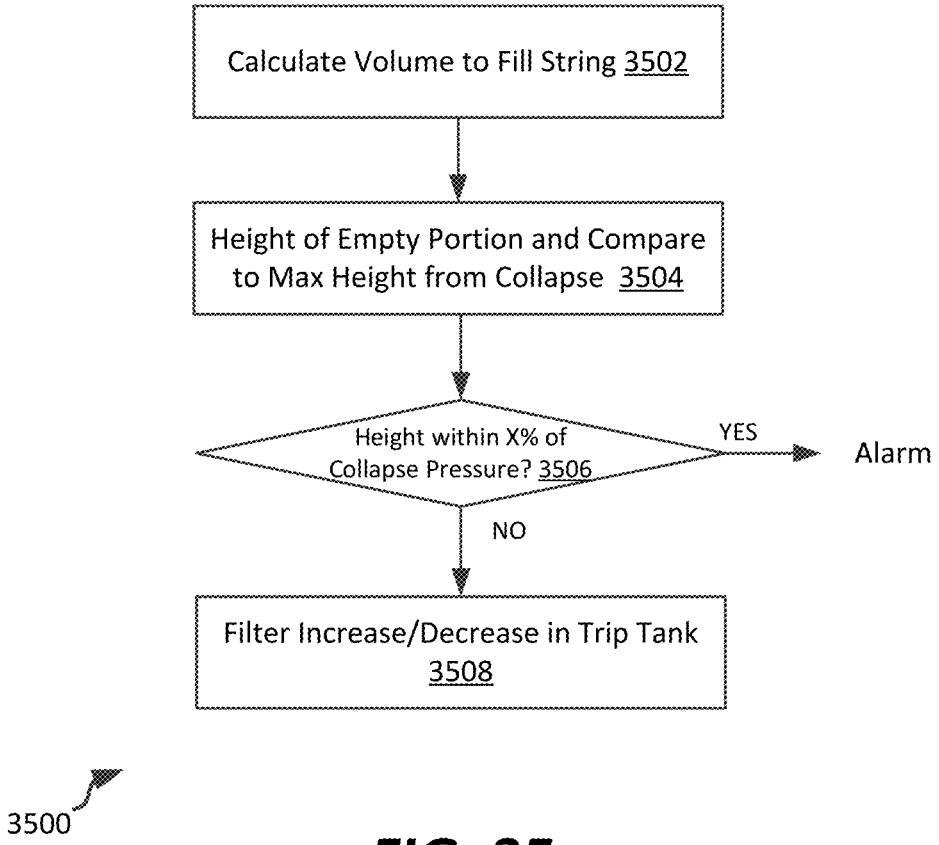
FIG. 35 is a flowchart of a method of alarming based on a possible pipe collapse event, executable within the automated well event detection and response system of FIG. 2, according to an example embodiment.

Referring now to FIG. 35, an example a flowchart of a method 3500 of alarming based on a possible pipe collapse event is illustrated. The method 3500 is executable within the automated well event detection and response system of FIG. 2, according to an example embodiment. In example embodiments, the method 3500 is performed during closed-ended tripping, and bases the pipe collapse pressure warning on a calculation of a volume of drilling mud that would fill the drill string (e.g., to counteract external pressures occurring at a bottom hole location.

In the embodiment shown, the alarming process for a pipe collapse event is monitored by first calculating a volume required to fill a current drill string (step 3502). This is based, for example, on a size of the drill string (e.g., diameter, internal volume per unit length) and a length of the drill string currently used. The size of the drill string affects a displacement of the drill string, which can be calculated for purposes of the pipe collapse alarm as a difference between an exerted pressure within and external to the drill string.

To determine an amount of drilling mud present within the drill string, in some embodiments the system will calculate the strokes and pumped volume based on those strokes. If the pumped volume is greater than a required volume to fill the drill string, the required volume will be reset and recalculated; however, if the pumped volume is less than is required to fill the drill string, a height of the empty portion of the drill string is calculated (step 3504). The calculated empty portion of the drill string is then compared to a calculated portion of the drill string that is acceptable to be empty before a pipe collapse condition would arise. If the height of the empty portion of the drill string implicates a pressure within a predetermined threshold of a collapse pressure (step 3506), an alarm is generated and presented to a user (e.g., via the user interface of FIG. 3, or other means). Alternatively, if the height of the empty portion of the drill string does not result in a pressure difference within the threshold of a collapse pressure, a filtering operation is performed to manage trip tank levels, to compensate for activation/deactivation of the trip tank pump (step 3508), allowing for continued accurate trip tank-based monitoring of bottom hole pressure. If the difference in pressure does not exceed the collapse threshold, no alarm will be produced.

Figure 36:
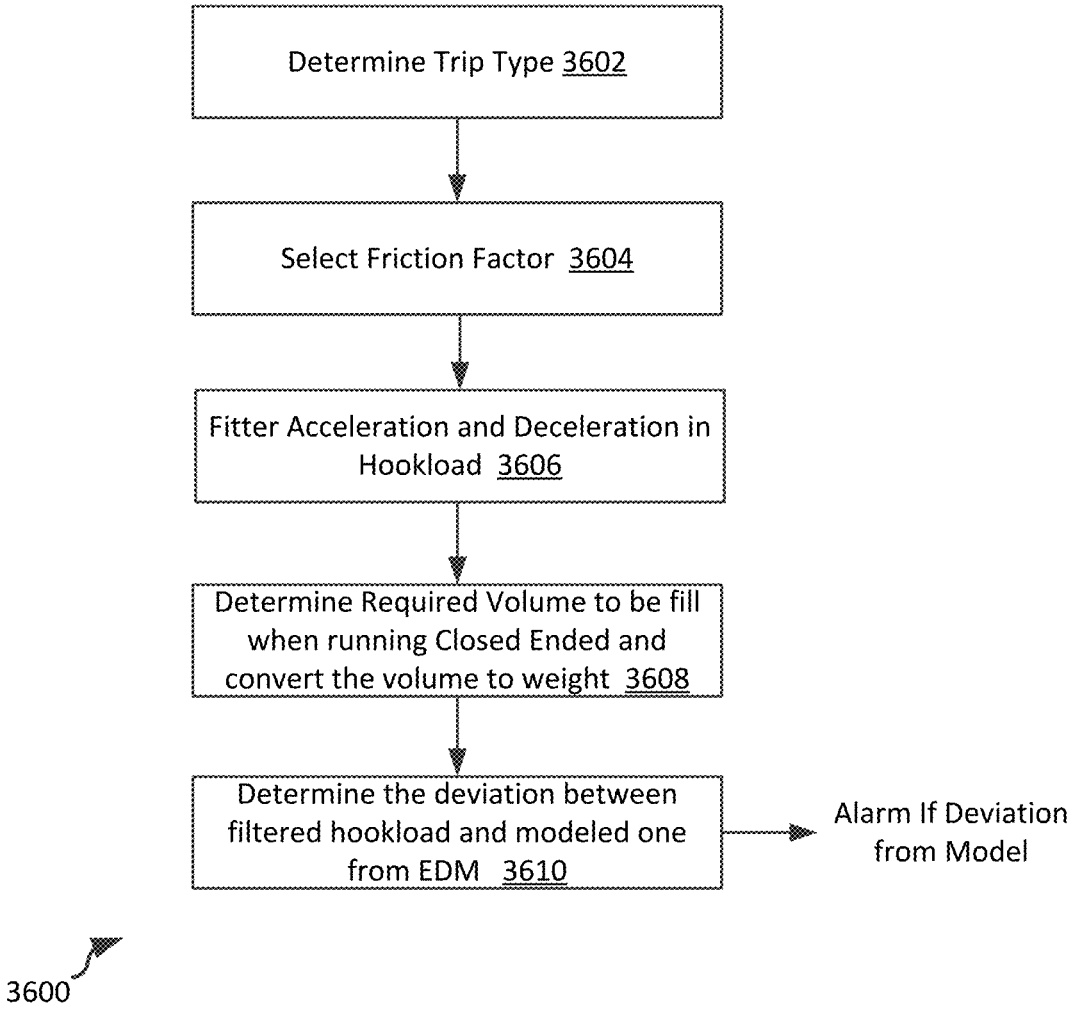
FIG. 36 is a flowchart of a method of alarming based on a drag event, executable within the automated well event detection and response system of FIG. 2, according to an example embodiment.
Figure 37:
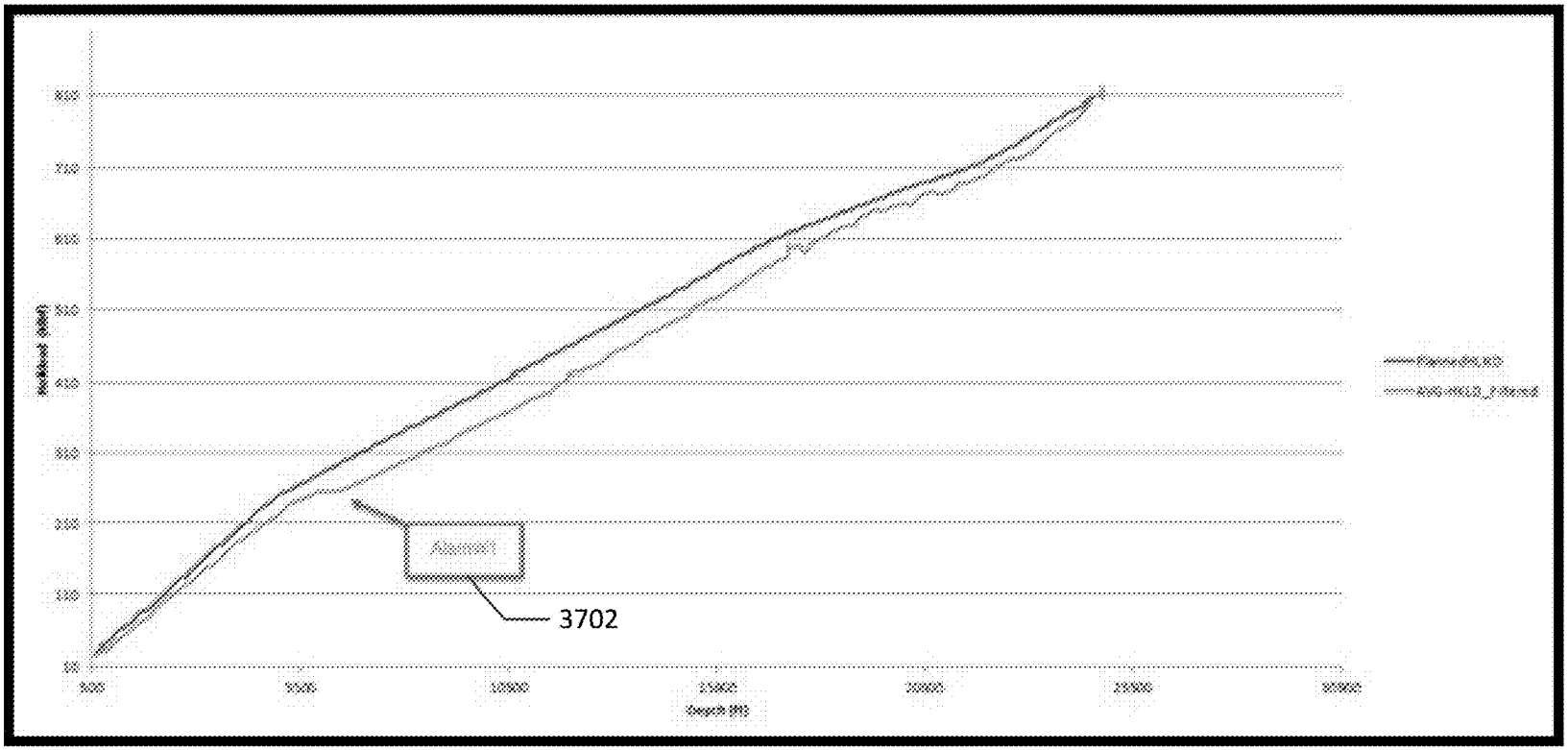
FIG. 37 is a graphical view of a drag alarm being generated, in the graphical user interface of FIG. 3, according to a possible embodiment of the present disclosure.

Referring to FIGS. 36-37, details regarding a drag alarm are provided. An increase in drag alarm may occur, for example, where a drill string is being operated at too high a speed, and is experiencing substantial hookload stress that may result in damage to the drill string and/or may cause breakage of the formation around the wellbore, resulting in loss of drilling mud and various other drilling problems.

Referring first to FIG. 36, a flowchart of a method 3600 is illustrated in which alarming based on a drag event occurs, according to an example embodiment. In the example shown, a trip type is first determined (step 3602). The trip type can be, for example, selected from among an open ended trip and a closed ended trip, based on user input or based on whether stand pipe pressure changes when pumping using rig pumps is performed. The method 3600 includes allowing a user to select a friction factor (step 3604), which allows the user to select a constant that models the average friction experienced per stand length in the wellbore. This friction factor can, for example, be representative of the type of materials into which the tripping operation is performed.

In the example shown, a filtered hookload can be generated by filtering acceleration and deceleration from the hookload (step 3606) to generate a filtered hookload curve. Furthermore, a required volume of drilling mud to be filled (when running closed-ended) can be converted to a weight (step 3608). The filtered hookload curve that is monitored during tripping can be compared to a model hookload curve that is expected given the drill string parameters and the friction factor (step 3610). If a difference between the filtered hookload and the model hookload is greater than a predetermined threshold, it is likely that the drill string is encountering one of two conditions. First, the drill string could be experiencing a greater-than-expected hookload, and therefore may require intervention to reduce operation speed to reduce the experienced hookload. Second, the drill string may be experiencing a lower-than-expected hookload, and therefore an operational speed may be increased, as long as the actual running speed is below the modeled running speed. Accordingly, an alarm will be generated, to draw operator attention to one of these types of events. If the filtered hookload is not outside of a threshold of the model hookload, no alarm will be generated.

Referring now to FIG. 37, a graphical view 3700 of hookload curves is presented illustrating an instance of a drag alarm, according to a possible embodiment. In the example shown, an alarm event 3702 occurs where the experienced (filtered) hookload diverges from the modeled hookload by greater than a threshold. In this case, the experienced hookload is below the modeled threshold, resulting in an alarm to indicate to the user to possibly slow operation of the drilling rig.

Figure 38:
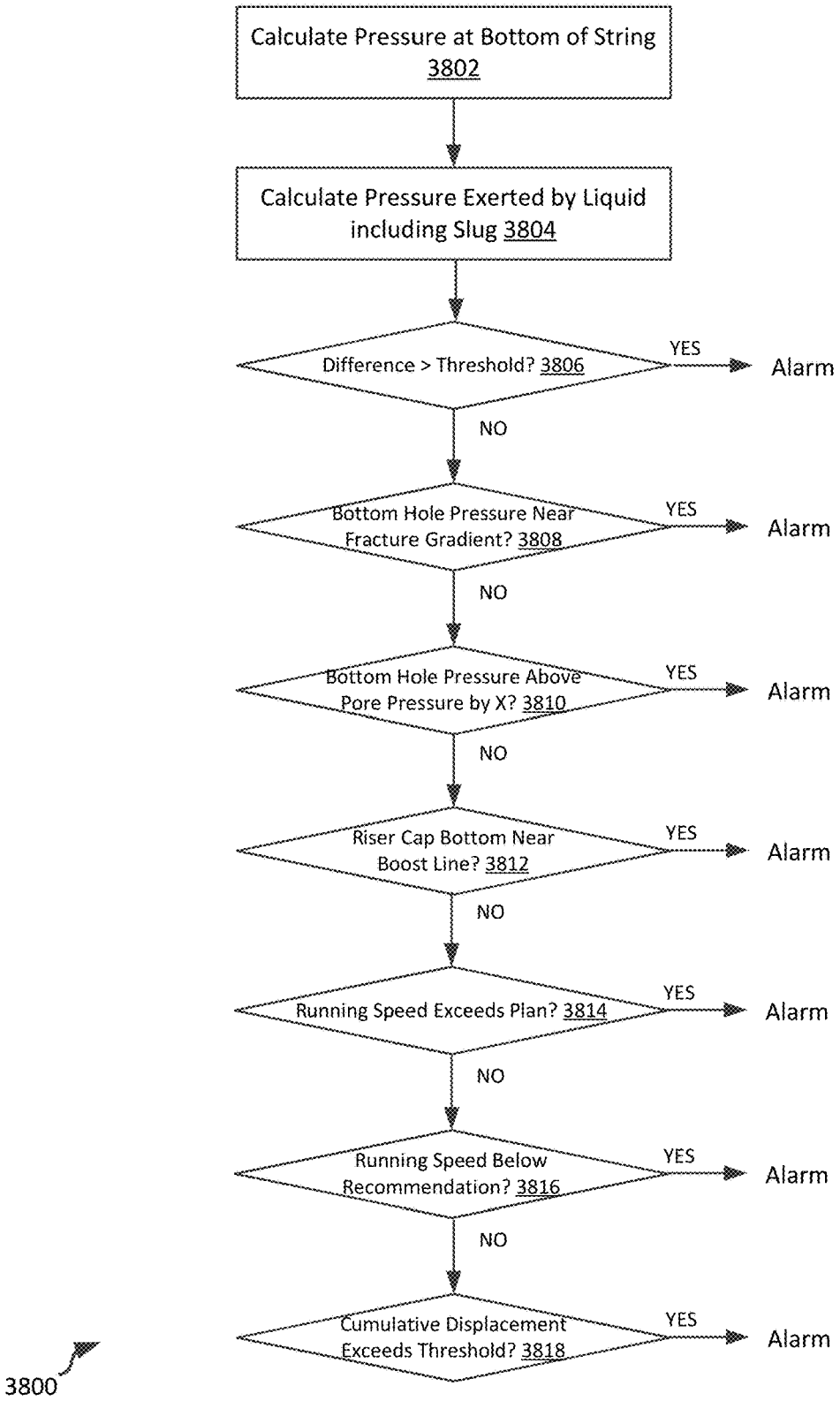
FIG. 38 is a flowchart of a method of generating automated alarms executable within the automated well event detection and response system of FIG. 2, according to an example embodiment.

In addition to the bottom hole pressure, drill string collapse, and hookload alarms, a variety of other alarming operations can be performed as well. In one example, and as illustrated in FIG. 38, a further method 3800 is illustrated for generating automated alarms executable within the automated well event detection and response system of FIG. 2, according to an example embodiment.

In the example shown, alarms such as a u-tubing alarm, various additional bottom hole pressure alarms, a riser cap alarm, running speed alarms, and a displacement alarm can be generated. Other alarm events could be assessed and alarms generated as well.

As shown, a bottom hole pressure is calculated (step 3802). The bottom hole pressure can be calculated as discussed previously, based on whether the drilling rig is currently pumping or operational, or whether it is currently not in operation. Bottom hole pressure can be assessed and modified based on both a riser cap (as noted above) but also based on a slug included in the drill string (step 3804). Similar to the riser cap, the slug corresponds to a higher-density portion of drilling mud included in the drill string such that, when a particular stand of the drill string is broken away from the drill string and removed, pressure equalization does not cause a substantial amount of drilling mud to be expelled on the rig platform. However, because of the existence of such a slug within the drill string, bottom hole pressure can be affected. Determination of the bottom hole pressure based on both the slug and riser cap is analogous to determination of a bottom hole pressure based on the riser cap alone, as was previously described.

In the embodiment shown, a u-tube alarm assessment operation (operation 3806) can be performed to determine a difference in pressure between a pressure within the drill string and a pressure within the annulus. To do so, operation 3806 includes using the bottom hole pressure, as determined based on the riser cap and a bottom hole pressure exerted by the drill string as modified by the slug. The annulus pressure and drill string pressure are compared, and if outside of a predetermined threshold, an alarm is generated to indicate an imbalance between those pressures. The alarm indicates that there is a lack of pressure balance between the interior and exterior of the drill string.

A further alarm can be generated (at operation 3808) when it may be determined whether a bottom hole pressure is approaching a fracture gradient (e.g., is within a predetermined difference in pressure, or percent difference in pressure, as compared to the fracture gradient). To assess whether to generate such an alarm, the system can receive a fracture gradient from a user, and monitor, in realtime or periodically, whether the bottom hole pressure approaches that gradient, and generate an alarm accordingly.

A still further alarm can be generated (at operation 3810), when the bottom hole pressure is approaching a pore pressure. As with the fracture gradient, a pore pressure can be received from a user, and an alarm generated when the monitored bottom hole pressure is below a predetermined difference from, or percentage difference from, the pore pressure.

In a still further possible scenario, a riser cap positioning alarm can be generated (at operation 3812) to notify a user if a bottom of the riser cap is more than a predetermined distance above the boost line. This may indicate, for example, that there is too much drilling mud below the riser cap within the annulus.

Figure 39:
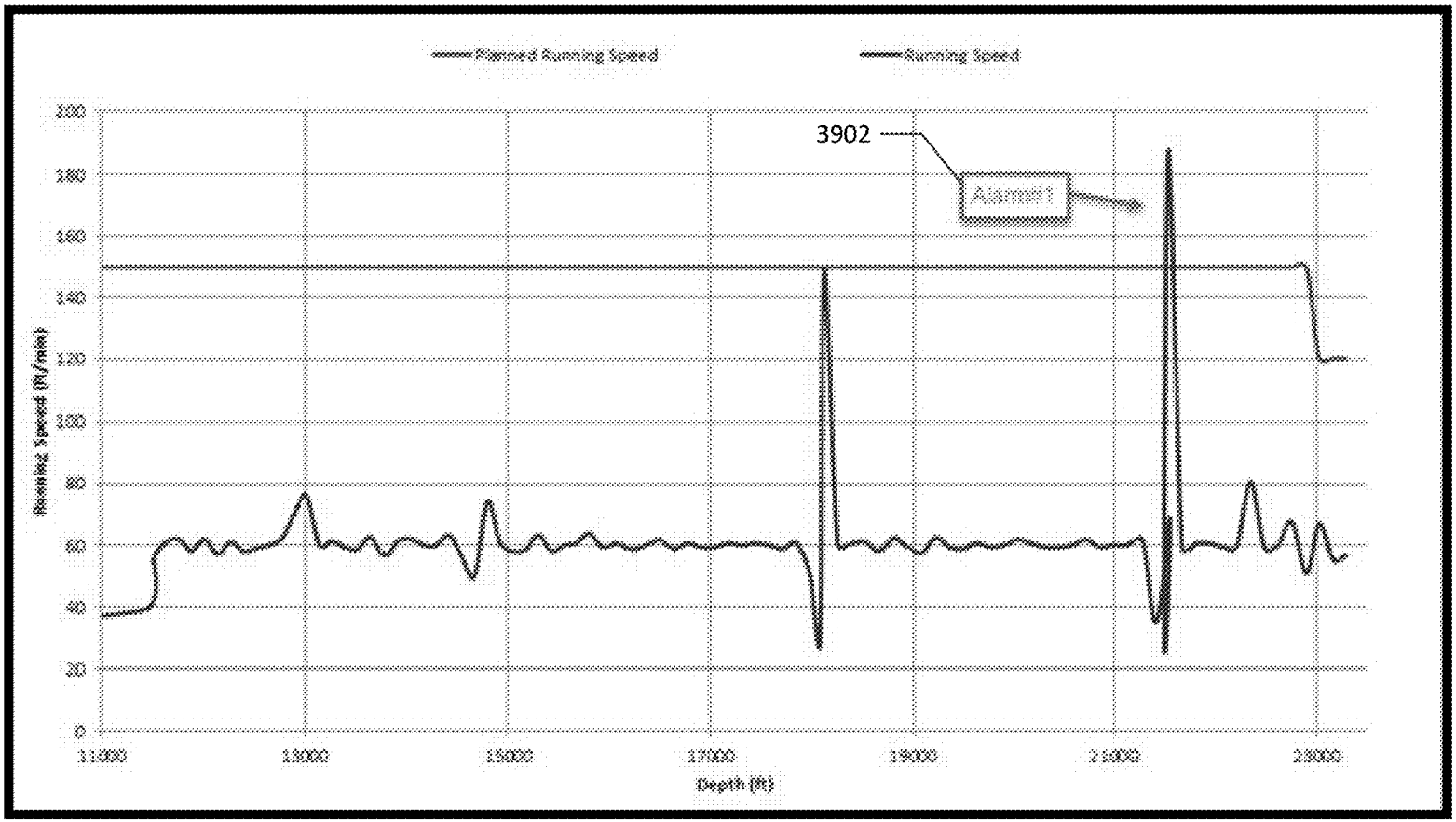
FIG. 39 is a graphical view illustrating monitored and alarmed running speed, in the graphical user interface of FIG. 3, according to a possible embodiment of the present disclosure.

Additionally, a running speed alarm assessment can be performed (at operation 3814) in which the system can determine whether a planned running speed is being exceeded. To do so, the application will determine whether the tripping being performed is open-ended or closed-ended (either by user input or during filling of the string), and then monitoring running speed in realtime. If the running speed exceeds a planned running speed based on a model, one alarm will be generated each time the running speed exceeds that planned speed for each stand or joint included in the drill string. One example of such a running speed alarm is illustrated in FIG. 39. In that illustration, a graphical view 3900 showing an alarm 3902 being generated when the running speed spikes to a level greater than a modeled running speed. Accordingly, a user can determine whether an adjustment to the running speed is required, or if the change in running speed is indicative of some other anomalous behavior of the drilling rig.

Returning to FIG. 38, a further running speed alarm assessment can be performed (at operation 3816) in which the system can determine whether a running speed is below a recommended running speed for the drilling rig. As with the first running speed alarm assessment, the application will determine whether the tripping being performed is open-ended or closed-ended (either by user input or during filling of the string), and then monitors running speed in realtime. In this instance, an alarm is generated if the current running speed is a predetermined amount less (e.g., in feet per minute, or some other measure) less than a modeled ideal running speed. The current and modeled running speed account for, among other factors: whether displacement for a stand or joint exceeds a loss threshold, or if loss trends indicate high losses; whether a drag alarm event is generated, as described above; and whether a wind speed exceeds a user-defined threshold. If any of these assessments are true, the running speed alarm may not be generated, since there may be reason to operate the drill string at a lower-than-modeled speed. Additionally, because of the possibility that a lower-than-modeled speed is user selected, in some embodiments, this second drilling speed alarm can be user-adjustable, either to deactivate this alarm or to reduce its frequency.

In the embodiment shown, a still further alarm assessment can be performed by the system based on a monitored cumulative displacement of drilling mud during tripping (operation 3818). In this assessment, an alarm is generated if a gain or loss of drilling mud for a particular number of stands exceeds a threshold amount for a particular operation type. For example, an alarm may be generated if more than one barrel of drilling mud is lost per one stand during tripping with trip tanks, or if more than two barrels of drilling mud is lost per one stand during tripping using an active system.

One example of such a cumulative displacement alarm can be seen in the chart of operational data depicted in FIG. 40. In that example, a displacement monitoring table 4000 illustrates a series of drill stands that each experience less than one barrel of gain, based on actual and calculated displacement. In this scenario, a one barrel threshold is never reached, but because a cumulative trend of gain is observed, an alarm may be generated.

Additionally, an alarm may be generated if a trend toward gain or loss is experienced, even if, on a per-stand basis, the threshold that was set is not exceeded. Additionally, various events, such as might occur during start/stop of the system, as well as when turning a trip tank on or off, can be filtered out by the system during operation 3818.

Figure 41:
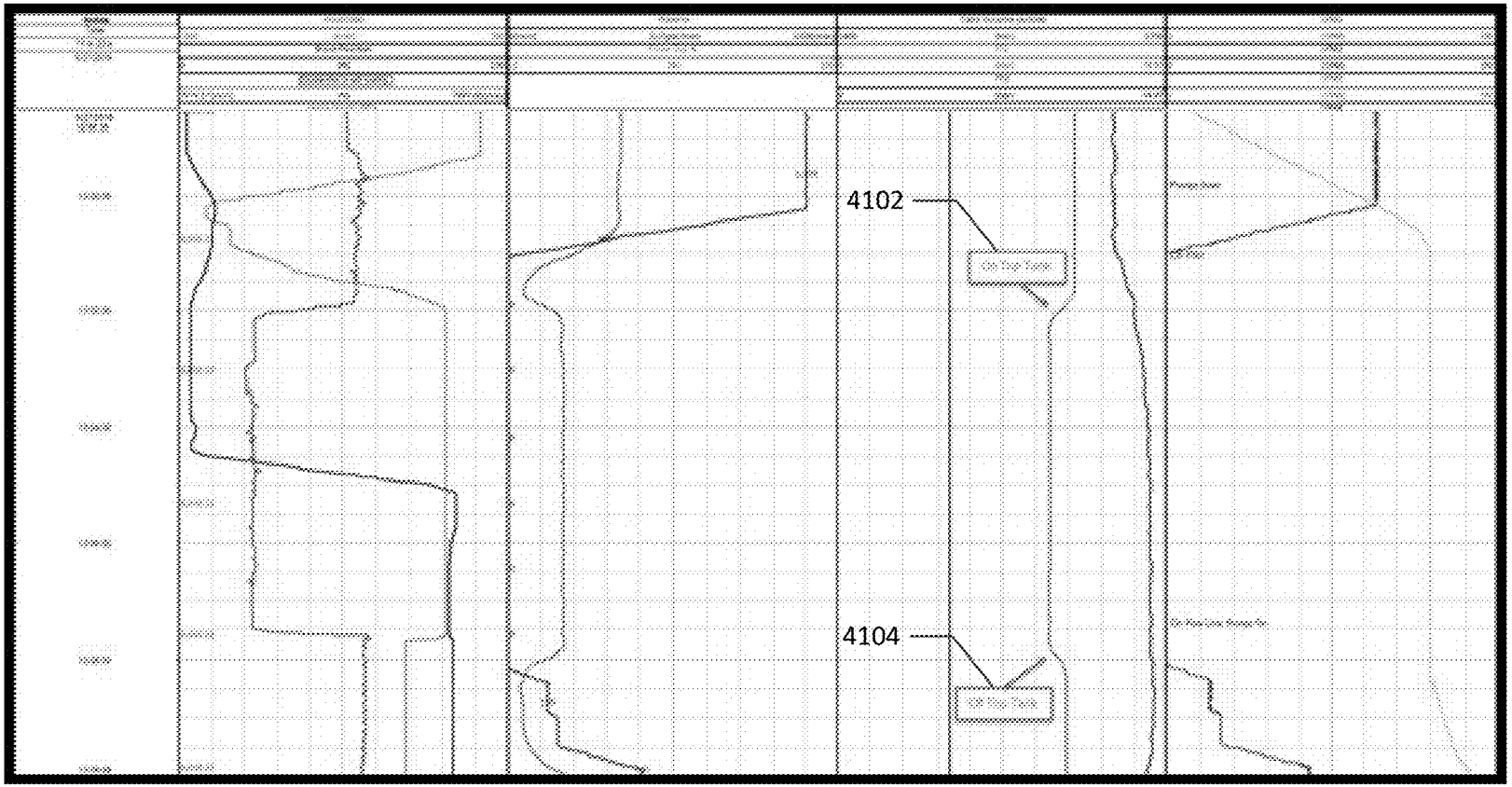
FIG. 41 is a graphical view of monitoring and alarming on over/under displacement, in the graphical user interface of FIG. 3, according to a possible embodiment of the present disclosure.

A further illustration of operation in which cumulative displacement can be assessed is depicted in the graphical display 4100 of FIG. 41. In that example, turning on and off a trip tank is illustrated at operations 4102, 4104, respectively. At these times, changes to gain/loss can be disregarded for purposes of alarming.

Although method 3800 illustrates a sequence of tests performed to determine whether to generate alarms, it is noted that a variety of other types of implementations are possible. For example, each of the tests performed in method 3800 can be executed discretely and independently, or could be combined with any of the assessments associated with the bottom hole pressure, drill string collapse, and hookload events previously described. Additionally, a sequence of tests may differ in order, and the various tests can be performed with varying frequency from one another, depending upon the perceived severity or likelihood of an alarm event occurring.

Referring to FIG. 38 generally, and more generally to FIGS. 27-41, it is noted that of the plurality of alarms described herein, only a subset were previously events that are recognizable to the realtime operator. For example, riser cap expansion, running speed, and bottom hole pressure gradients may be detectable or calculable by a realtime operator; however, various extension and de-extension in fluids (e.g., the riser cap, slug, and drilling mud), and that corresponding effect on downhole pressure, would not previously be able to be assessed in realtime by a realtime operator. Furthermore, although the realtime operator may be able to assess divergent running speed relative to a modeled or ideal running speed, that realtime operator would not be able to, in realtime, assess a cost penalty for diverging from that running speed, which is also made possible by the system and alarming described herein. This has specific, real-world economic advantages: for example, a running speed optimization may save more than $100,000 in operating costs for a particular drilling rig per trip, leading to millions of dollars in savings on a lifetime basis for a drilling rig. Furthermore, user errors, such as might cause fracture of subsurface structures, may cause substantial costs, and may be detected and avoided earlier using the alarming described herein.

Furthermore, it is noted that the alarms generated based on the methodology described in connection with FIGS. 27-41 can be visualized in a variety of ways within the user interface 300 of FIG. 3, as generated by well event detection and response application 212. For example, the alarms may be visualized as events on a graph, as depicted herein, or within data tables as well. Specifically, swab and surge events during tripping into or out of the wellbore can be highlighted, predicated on evaluation of trip speed and trip tank behaviors. Surge pressure refers to pressure created when drill pipe moves downward with mud pushed into the formation. In such instances, additional bottom hole pressure called "surge pressure" is created. If surge pressure is too high, many problems may occur, including partial mud loss and lost circulation. Such surge events can be detected via the displacement alarms described above. For example, while tripping into the hole, if the actual running speed exceeds the theoretical running speed and the trip tank alarms of improper displacement values, a surge event may be underway in that instance.

Similarly, swab pressure refers to the change in pressure that occurs when casing string or tubulars are being pulled out of the hole too quickly, which may swab drilling mud out of the formation, like pulling a piston of a syringe. For this reason, hydrostatic pressure of bottom hole will be reduced. Pressure reduction created by this situation is called "swab pressure". If swab events occur, a kick (wellbore hydrocarbon influx from the formation) may emerge into the hole. When that occurs, well control must be conducted to secure the well. Such swab events can be detected via the comparison between realtime data with modeled running speed, and bottom hole pressure monitoring described above. For example, while tripping out of the hole, if the actual running speed exceeds the theoretical running speed and the trip tank alarms of improper displacement values, a swab event may be underway in that instance. Alarms generated may notify the user of such a swab event.

In addition to the above, various other informational alerts may be generated by the well event detection and response application 212 and displayed via user interface 300. For example, the user interface 300 may display a schematic of the well bore and bottom hole assembly in the well with actual bit depth as the drill string is being run or pulled from the well. In other applications, it may be possible to generate an automated trip sheet report. The trip sheet display may exhibit other functionalities not described herein.

Other alarms described above also have advantages. Monitoring and responding to potential swab and surge alarms can improve efficiency and reduce costs. For example, lost circulation of fluids in the well may increase non-productive time spent by operators to address lost circulation problems. A swab of hydrocarbons from the subterranean formation also is a highly undesirable well control event. Working a drill sting within acceptable torque and drag limitations may assist in reducing drill string wear and preventing drill sting failure, so maintaining a proper running speed is critical to cost-effective tripping.

Referring generally to the systems and methods of FIGS. 1-41, above, and referring to in particular computing systems embodying the methods and systems of the present disclosure, it is noted that various computing systems can be used to perform the processes disclosed herein. For example, embodiments of the disclosure may be practiced in various types of electrical circuits comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, aspects of the methods described herein can be practiced within a general purpose computer or in any other circuits or systems.

Embodiments of the present disclosure can be implemented as a computer process (method), a computing system, or as an article of manufacture, such as a computer program product or computer readable media. The term computer readable media as used herein may include computer storage media. Computer storage media may include volatile and nonvolatile, removable and non-removable media implemented in any method or technology for storage of information, such as computer readable instructions, data structures, or program modules. Computer storage media may include RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other article of manufacture which can be used to store information and which can be accessed by the computing system 500, above. Computer storage media does not include a carrier wave or other propagated or modulated data signal. In some embodiments, the computer storage media includes at least some tangible features; in many embodiments, the computer storage media includes entirely non-transitory components.

The description and illustration of one or more embodiments provided in this application are not intended to limit or restrict the scope of the invention as claimed in any way. The embodiments, examples, and details provided in this application are considered sufficient to convey possession and enable others to make and use the best mode of claimed invention. The claimed invention should not be construed as being limited to any embodiment, example, or detail provided in this application. Regardless whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope.

The invention claimed is:

1. A computer-implemented method for realtime remote management of operation of a drilling rig, the method comprising:

monitoring a calculated actual vertical running speed of a drill string during tripping of the drill string into a subterranean well from the drilling rig;

monitoring one or more properties of a riser cap, the riser cap comprising a fluid having a hydrostatic density greater than that of a drilling mud used in operation of the drilling rig, the riser cap being located in an annulus within a riser and external to the drill string, the riser cap having a top level and a bottom level;

calculating a bottom hole pressure effect exerted by the riser cap, including calculating a position within the riser of the top level and a position within the riser of the bottom level of the riser cap based at least in part on a set of positioning rules and the one or more properties of the riser cap, the positioning rules defining a total volume within the riser and a choke line connected to the riser and accounting for a difference between an original weight of the drilling mud used in operation of the drilling rig and a combined weight of the drilling mud and riser cap; and outputting an adjusted running speed for the drill string based, at least in part, on the bottom hole pressure effect exerted by the riser cap and drilling mud within the annulus.

2. The computer-implemented method of claim 1, further comprising:

comparing the calculated actual vertical running speed to a theoretical maximum vertical running speed of the drill string, wherein outputting the adjusted running speed for the drill string is further based, at least in part, on the theoretical maximum vertical running speed.

3. The computer-implemented method of claim 1, further comprising determining a total volume of the drilling mud pumped behind the riser cap.

4. The computer-implemented method of claim 1, further comprising:

determining a pumping method of operation of the drilling rig;

calculating a total number of strokes required to fill a line via which the fluid is delivered to the annulus; and determining, based on whether a total volume pumped via the pumping method is less than a total volume required, whether to generate a low level alarm or to calculate the bottom hole pressure effect exerted by the riser cap.

5. The computer-implemented method of claim 1, wherein calculating the position of the top level and the position of the bottom level includes calculating a total volume of the fluid added to the riser cap by at least one of a rig pump or a booster pump.

6. The computer-implemented method of claim 1, wherein outputting the adjusted running speed comprises generating a display of a recommended adjusted running speed.

7. The computer-implemented method of claim 1, wherein outputting the adjusted running speed comprises transmitting to the drilling rig a recommended adjusted running speed.

8. The computer-implemented method of claim 1, further comprising monitoring a bit depth and a wind speed at the drilling rig, and displaying, in at least near-realtime, a correlation between the wind speed and the bit depth.

9. The computer-implemented method of claim 8, further comprising monitoring a drag force of the drill string and the bit depth and displaying, in at least near-realtime, a correlation between the drag force and the bit depth.

10. The computer-implemented method of claim 9, further comprising, based at least in part on display of the correlation between the wind speed and the bit depth, receiving a recommended adjusted running speed from a user of the system.

11. The computer-implemented method of claim 1, further comprising:

calculating a required volume of the drilling mud required to fill the drill string during the tripping, including calculating a volume of each stand of the drill string, based on the geometry of each stand of the drill string;

comparing a height of an empty portion of the drill string to a maximum height of empty pipe to cause collapse of the drill string; and based on a difference between pressure exerted on the pipe being within a predetermined threshold of a collapse pressure derived from the maximum height of empty pipe, generating an alarm.

12. The computer-implemented method of claim 1, further comprising:

selecting a friction factor;

comparing a filtered hookload to a model curve of expected drag based on the friction factor; and output an alert to a user based on detection of a divergence between the filtered hookload and the model curve of expected drag greater than a predetermined threshold.

13. The computer-implemented method of claim 1, further comprising:

calculating a bottom hole pressure effect exerted by a slug included within the drill string, the slug comprising a fluid having a higher density than the drilling mud;

calculating the pressure exerted from within the drill string based at least in part on the presence of the slug;

comparing a pressure exerted from within the drill string to a pressure exerted on the drill string within the annulus; and generating an alarm based on a determination that a difference between the pressure exerted from within the drill string and the pressure exerted on the drill string within the annulus exceeds a predefined threshold.

14. A system for managing drill rig operations, comprising:

a computing system communicatively connected to at least one drilling rig, the at least one drilling rig comprising a drilling mechanism controlling tripping of a drill string into a subterranean well, the computing system comprising:

a communication interface;

a microprocessor operatively connected to the communication interface to receive operational data from the at least one drilling rig; and a memory storing instructions forming an automated tripping management application which, when executed by the microprocessor, causes the computing system to perform a method for realtime remote management of operation of the drilling rig, the method comprising:

monitoring a calculated actual vertical running speed of the drill string during tripping of the drill string into the subterranean well from the drilling rig;

monitoring one or more properties of a riser cap, the riser cap comprising a fluid having a hydrostatic density greater than that of a drilling mud used in operation of the drilling rig, the riser cap being located in an annulus within a riser and external to the drill string, the riser cap having a top level and a bottom level;

calculating a bottom hole pressure effect exerted by the riser cap, including calculating a position within the riser of the top level and a position within the riser of the bottom level of the riser cap based at least in part on a set of positioning rules and the one or more properties of the riser cap, the positioning rules defining a total volume within the riser and a choke line connected to the riser and accounting for a difference between an original weight of the drilling mud used in operation of the drilling rig and a combined weight of the drilling mud and riser cap; and outputting an adjusted running speed for the drill string based, at least in part, on the bottom hole pressure effect exerted by the riser cap and drilling mud within the annulus.

15. The system of claim 14, further comprising the at least one drilling rig.

16. The system of claim 14, further comprising a plurality of drilling rigs located remotely from the computing system.

17. The system of claim 14, wherein the computing system includes a plurality of computing devices accessible to a plurality of different operational users.

18. The system of claim 14, wherein the instructions further cause the computing system to:

import a plurality of types of rig data, the plurality of types of rig data including fracture gradient data and pore pressure data; and generate an alarm based on a determination that the bottom hole pressure effect exerted by the riser cap is within a predetermined threshold of a pressure defined at least in part by one of the fracture gradient data and pore pressure data.

19. The system of claim 18, wherein the computing system further comprises a display on which the alarm is displayed.

20. A system for managing drill rig operations, comprising:

a computing system communicatively connected to at least one drilling rig, the at least one drilling rig comprising a drilling mechanism controlling tripping of a drill string into a subterranean well, the computing system comprising:

a communication interface;

a microprocessor operatively connected to the communication interface to receive operational data from the at least one drilling rig;

a memory storing instructions forming an automated tripping management application which, when executed by the microprocessor, causes the computing system to perform a method for realtime remote management of operation of the drilling rig, the method comprising:

monitoring a calculated actual vertical running speed of the drill string during tripping of the drill string into the subterranean well from the drilling rig;

monitoring one or more properties of a riser cap, the riser cap comprising a fluid having a hydrostatic density greater than that of a drilling mud used in operation of the drilling rig, the riser cap being located in an annulus within a riser and external to the drill string, the riser cap having a top level and a bottom level;

calculating a bottom hole pressure effect exerted by the riser cap, including calculating a position within the riser of the top level and a position within the riser of the bottom level of the riser cap based at least in part on a set of positioning rules and the one or more properties of the riser cap, the positioning rules defining a total volume within the riser and a choke line connected to the riser and accounting for a difference between an original weight of the drilling mud used in operation of the drilling rig and a combined weight of the drilling mud and riser cap;

calculating a bottom hole pressure effect exerted by a slug included within the drill string, the slug comprising a fluid having a higher density than the drilling mud;

calculating the pressure exerted from within the drill string based at least in part on the presence of the slug;

comparing a pressure exerted from within the drill string to a pressure exerted on the drill string within the annulus; and performing at least one of (1) generating an alarm based on a determination that a difference between the pressure exerted from within the drill string based in part on the slug and the pressure exerted on the drill string within the annulus based in part on the riser cap exceeds a predefined threshold, or (2) outputting an adjusted running speed for the drill string based, at least in part, on the bottom hole pressure effect exerted by the riser cap, slug, and drilling mud within the annulus and drill string.

* * * * *